US010556157B2

(12) United States Patent
Greaney et al.

(10) Patent No.: US 10,556,157 B2
(45) **Date of Patent: *Feb. 11, 2020**

(54) GOLF CLUB HEAD

(71) Applicant: Taylor Made Golf Company, Inc., Carlsbad, CA (US)

(72) Inventors: Mark Vincent Greaney, Vista, CA (US); Kraig Alan Willett, Fallbrook, CA (US); Joe Hoffman, Carlsbad, CA (US); Todd P. Beach, Encinitas, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 22 days.

This patent is subject to a terminal disclaimer.

(21) Appl. No.: 16/037,947

(22) Filed: Jul. 17, 2018

(65) Prior Publication Data

US 2018/0318662 A1 Nov. 8, 2018

Related U.S. Application Data

(63) Continuation of application No. 15/811,430, filed on Nov. 13, 2017, now Pat. No. 10,265,586, which is a (Continued)

(51) Int. Cl.
*A63B 53/04* (2015.01)
*A63B 53/02* (2015.01)

(52) U.S. Cl.
CPC ..... *A63B 53/04* (2013.01); *A63B 53/0466* (2013.01); *A63B 2053/023* (2013.01); (Continued)

(58) Field of Classification Search
CPC ..... A63B 53/04; A63B 53/0466; A63B 2053/0408; A63B 2053/023; (Continued)

(56) References Cited

U.S. PATENT DOCUMENTS 1,674,173 A 6/1928 Haupt
2,023,885 A 12/1935 Hinckley
(Continued)

OTHER PUBLICATIONS

Covey, "Ultimate Review—Adams Speedline," https://mygolfspy.com/adams-speedline-tech-driver-review/, retrieved Feb. 27, 2018; 23 pages (Aug. 28, 2012).
(Continued)

*Primary Examiner* — Sebastiano Passaniti
(74) *Attorney, Agent, or Firm* — Klarquist Sparkman, LLP

(57) ABSTRACT

A golf club head is described having a club head portion, a shaft portion connected to the club head portion, and a grip portion connected to the shaft portion. The club head portion has a heel portion, a sole portion, a toe portion, a crown portion, a hosel portion, and a striking face. The striking face has a center face roll contour, a toe side roll contour, a heel side roll contour, a center face bulge contour, a crown side bulge contour, and a sole side bulge contour. The toe side roll contour is more lofted than the center face roll contour. The heel side roll contour is less lofted than the center face roll contour. The crown side bulge contour is more open than the center face bulge contour, and the sole side bulge contour is more closed than the center face bulge contour.

20 Claims, 12 Drawing Sheets

Related U.S. Application Data continuation of application No. 15/199,603, filed on Jun. 30, 2016, now Pat. No. 9,814,944.

(52) U.S. Cl.
CPC ..... *A63B 2053/0408* (2013.01); *A63B 2053/0416* (2013.01); *A63B 2053/0458* (2013.01); *A63B 2053/0491* (2013.01)

(58) Field of Classification Search
CPC .... A63B 2053/0491; A63B 2053/0416; A63B 2053/0458
USPC ..... 473/324–350, 287–292
See application file for complete search history.

(56) References Cited

U.S. PATENT DOCUMENTS

| | | | |
|---|---|---|---|
| 3,625,518 | A | 12/1971 | Solheim |
| 4,367,878 | A | 1/1983 | Schmidt |
| 4,471,961 | A | 9/1984 | Masghati |
| 4,521,022 | A | 6/1985 | Schmidt |
| 4,725,062 | A | 2/1988 | Kinney |
| 5,098,103 | A | 3/1992 | MacKeil |
| 5,141,231 | A | 8/1992 | Cox |
| 5,310,185 | A | 5/1994 | Viollaz |
| 5,322,285 | A | 6/1994 | Turner |
| 5,415,405 | A | 5/1995 | Vincent |
| 5,857,920 | A | 1/1999 | Hong |
| 6,093,115 | A | 7/2000 | Murtland |
| 6,139,445 | A | 10/2000 | Werner et al. |
| 6,402,639 | B1 | 6/2002 | Iwata et al. |
| 6,428,426 | B1 | 8/2002 | Helmstetter et al. |
| 6,454,664 | B1 | 9/2002 | Long |
| 6,582,322 | B2 | 6/2003 | Long et al. |
| 6,663,504 | B2 | 12/2003 | Hocknell et al. |
| 6,902,497 | B2 | 6/2005 | Deshmukh et al. |
| 7,056,227 | B2 | 6/2006 | Giraldi |
| 7,059,972 | B2 | 6/2006 | Miyamoto |
| 7,066,830 | B2 | 6/2006 | Day |
| 7,153,220 | B2 | 12/2006 | Lo |
| 7,186,190 | B1 | 3/2007 | Beach et al. |
| 7,789,766 | B2 | 9/2010 | Morris et al. |
| 7,850,538 | B1 | 12/2010 | Yoon |
| 7,887,431 | B2 | 2/2011 | Beach et al. |
| 8,012,039 | B2 | 9/2011 | Greaney et al. |
| 8,147,350 | B2 | 4/2012 | Beach et al. |
| 8,152,652 | B2 | 4/2012 | Curtis et al. |
| 8,167,737 | B2 | 5/2012 | Oyama |
| 8,388,459 | B2 | 3/2013 | Chuck |
| 8,496,544 | B2 | 7/2013 | Curtis |
| 9,814,944 | B1 | 11/2017 | Greaney et al. |
| 10,265,586 | B2 | 4/2019 | Greaney et al. |
| 10,265,587 | B2 | 4/2019 | Greaney et al. |
| 2006/0094532 | A1 | 5/2006 | Seeley |
| 2007/0275791 | A1 | 11/2007 | Shear |
| 2009/0088271 | A1 | 4/2009 | Beach et al. |
| 2010/0311520 | A1 | 12/2010 | Bezilla et al. |
| 2011/0207552 | A1* | 8/2011 | Finn ..... A63B 53/0466 473/342 |
| 2011/0263349 | A1 | 10/2011 | Kodama |
| 2013/0029780 | A1 | 1/2013 | Beno et al. |
| 2013/0079175 | A1 | 3/2013 | Lee |
| 2013/0210542 | A1* | 8/2013 | Harbert ..... A63B 53/04 473/338 |
| 2013/0324281 | A1 | 12/2013 | Boyd et al. |
| 2014/0349777 | A1 | 11/2014 | Beno et al. |
| 2015/0094164 | A1 | 4/2015 | Galvan et al. |
| 2018/0065003 | A1 | 3/2018 | Greaney et al. |
| 2018/0318659 | A1 | 11/2018 | Greaney et al. |
| 2018/0318660 | A1 | 11/2018 | Greaney et al. |
| 2018/0318661 | A1 | 11/2018 | Greaney et al. |

OTHER PUBLICATIONS

Declaration of Steven M. Nesbit in Support of Petition for Post-Grant Review of U.S. Pat. No. 9,814,944, filed Jul. 6, 2018, 84 pages.
Golf Digest, 57(1), 7 pages (Jan. 2006).
Post Grant Review of U.S. Pat. No. 9,814,944, Case No. PGR2018-00074, filed Jul. 6, 2018, 73 pages.
Statement by Applicant; 5 pages (executed on May 29, 2018).
Decision Granting Institution of Post-Grant Review of U.S. Pat. No. 9,814,944, Case No. PGR2018-00074, filed Jan. 24, 2019, 47 pages.

* cited by examiner

GOLF CLUB HEAD

CROSS REFERENCE TO RELATED APPLICATION

This application is a continuation of U.S. patent application Ser. No. 15/811,430, filed on Nov. 13, 2017, which is a continuation of U.S. patent application Ser. No. 15/199,603, filed on Jun. 30, 2016, now U.S. Pat. No. 9,814,944, both of which are incorporated herein by reference in their entirety.

FIELD

The present disclosure relates to a golf club head. More specifically, the present disclosure relates to a golf club head having a unique face construction.

BACKGROUND

When a golf club head strikes a golf ball, a force is seen on the club head at the point of impact. If the point of impact is aligned with the center face of the golf club head in an area of the club face typically called the sweet spot, then the force has minimal twisting or tumbling effect on the golf club. However, if the point of impact is not aligned with the center face, outside the sweet spot for example, then the force can cause the golf club head to twist around the center face. This twisting of the golf club head causes the golf ball to acquire spin. For example, if a typical right handed golfer hits the ball near the toe of the club this can cause the club to rotate clockwise when viewed from the top down. This in turn causes the golf ball to rotate counter-clockwise which will ultimately result in the golf ball curving to the left. This phenomenon is what is commonly referred to as "gear effect."

Bulge and roll are golf club face properties that are generally used to compensate for this gear effect. The term "bulge" on a golf club typically refers to the rounded properties of the golf club face from the heel to the toe of the club face.

The term "roll" on a golf club typically refers to the rounded properties of the golf club face from the crown to the sole of the club face. When the club face hits the ball, the ball acquires some degree of backspin. Typically this spin varies more for shots hit below the center line of the club face than for shots hit above the center line of the club face.

FIG. 1 illustrates the problem to be solved by the present invention. FIG. 1 shows a ball location with respect to the intended target when the golf ball is struck with a club having a constant bulge and roll radius. The nine rectangles indicate the ball location when struck in the respective heel, toe, center, high, center, low combinations. The fairway 124 is separated from the rough 126 by a fairway edge 120,122. The final ball location is shown with respect to an intended target line 118. The intended target line 118 is the line along which the golf club head center is aimed when the golf is at the address position. When the golf ball is struck in the high position, the golf ball tends to have a "left tendency" which means the ball's final resting position will be left of the target line 118 as illustrated by points 100, 102, and 104 shown in FIG. 1. When the golf ball is struck in the low position, the golf ball tends to have a "right tendency" which means the ball's final resting position will likely be to the right of the target line 118 as illustrated by points 112, 114,116 shown in FIG. 1. When a golf ball impacts the ball in the central horizontal portion of the face, the ball tends to come to rest on target relative to the target line 118 as illustrated by points 106,108,110 shown in FIG. 1.

A golf club design is needed to counteract the left and right tendency that a player encounters when the ball impacts a high or low position on the club head striking face.

SUMMARY OF THE DESCRIPTION

The present disclosure describes a golf club head comprising a heel portion, a toe portion, a crown, a sole, and a face.

The foregoing and other objects, features, and advantages of the invention will become more apparent from the following detailed description, which proceeds with reference to the accompanying figures.

According to one aspect of an embodiment of the present invention, a golf club a club head portion having a hosel portion, a heel portion, a sole portion, a toe portion, a crown portion, and a striking face is described. The golf club further has a shaft portion connected to the club head portion and a sleeve portion connected to the shaft portion. The sleeve portion is capable of adjusting the loft, lie, or face angle of the club head when removed from the hosel portion in a first configuration and reinserted into the hosel portion in a second configuration.

The golf club also has a grip portion connected to the shaft portion and a striking face having a center face location. A center face vertical plane passing through the center face location and intersecting with the striking face surface to define a center face roll contour is also described. A toe side vertical plane being spaced away from the center face vertical plane by 30 mm toward the toe portion and intersecting with the striking face surface to define a toe side roll contour is described.

A heel side vertical plane is described being spaced away from the center face vertical plane by 30 mm toward the heel portion and intersecting with the striking face surface to define a heel side roll contour. Furthermore, a center face horizontal plane passing through the center face location and intersecting with the striking face surface defines a center face bulge contour. A crown side horizontal plane being spaced away from the center face horizontal plane by 15 mm toward the crown portion and intersecting with the striking face surface to define a crown side bulge contour is described in one embodiment. A sole side horizontal plane that is spaced away from the center face horizontal plane by 15 mm toward the sole portion and intersects with the striking face surface to define a sole side bulge contour is describe.

In one embodiment, the toe side roll contour is more lofted than the center face roll contour. In yet another embodiment, the heel side roll contour is less lofted than the center face roll contour. In some embodiments, the crown side bulge contour is more open than the center face bulge contour. In certain embodiments described herein, the sole side bulge contour is more closed than the center face bulge contour.

In one embodiment, a point located at 20 mm above the center face location has a FA°Δ of between 0.1° and 4°. A point located at 20 mm above the center face location having a FA°Δ of between 0.3° and 3° is also described.

In one embodiment, a point located at 20 mm below the center face location has a FA°Δ of between −0.1° and −4°. A point located at 20 mm below the center face location having a FA°Δ of between −0.3° and −3° is further described.

In some embodiments, a critical point located at 15 mm above the center face location has a LA°Δ that is substantially unchanged compared to a 0° twist golf club head.

In yet another embodiment, a heel side point located at an x-y coordinate of (30 mm, 0 mm) has a LA°Δ relative to a center that is between 0° and −8°.

In another embodiment, a toe side point located at an x-y coordinate of (−30 mm, 0 mm) has a LA°Δ relative to a center that is between 0° and 8°.

In one embodiment, the striking face has a degree of twist that is between 0.1° and 5° when measured between two critical locations located at 15 mm above the center face location and 15 mm below the center face location.

According to one aspect of another embodiment of the present invention, a golf club is described having a striking face with a center face location and four quadrants. The four quadrants comprise an upper toe quadrant, an upper heel quadrant, a lower toe quadrant, and a lower heel quadrant. In one embodiment, the striking face is a twisted striking surface having a degree of twist wherein the upper toe quadrant, and upper heel quadrant have an average positive FA°Δ relative to a 0° twist golf club head.

In yet another embodiment, the lower toe quadrant and the lower heel quadrant that have an average FA°Δ that is negative relative to a 0° twist golf club head is described.

In one embodiment, the degree of twist is greater than 0° when measured between two critical locations located at 15 mm above the center face location and 15 mm below the center face location.

In another embodiment, the degree of twist is between 0.1° and 5° when measured between two critical locations located at 15 mm above the center face location and 15 mm below the center face location.

In yet another embodiment, the upper toe quadrant has an average FA°Δ of between 0.1° to 0.8° and the upper heel quadrant has an average FA°Δ of between 0.1° to 0.8°.

In one embodiment, the lower toe quadrant has an average FA°Δ of between −0.1° to −0.8° and the lower heel quadrant has an average FA°Δ of between −0.1° to −0.8°. According to one aspect of another embodiment of the present invention, a golf club is described having a club head portion, a shaft portion connected to the club head portion, and a grip portion connected to the shaft portion. The club head portion has a heel portion, a sole portion, a toe portion, a crown portion, a hosel portion, and a striking face. The striking face has a striking face surface, a center face point, an x-axis that is tangent to the center face point and is parallel to a ground plane extending in a heel-ward positive direction, and a y-axis that is tangent to the center face point and extending in an upwards positive direction toward the crown. The y-axis has a downwards negative direction toward the sole.

A plurality of points measured on the striking face surface along the y-axis having a FA°Δ rate of change is described. The FA°Δ rate of change is greater than zero.

In one embodiment, the FA°Δ rate of change is between 0.005°Δ/mm and 0.2°Δ/mm.

In another embodiment, a plurality of points measured on the striking surface along the x-axis having a LA°Δ rate of change that is between −0.005°Δ/mm and −0.2°Δ/mm is described.

BRIEF DESCRIPTION OF THE DRAWINGS

The present invention is illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Figure 1:
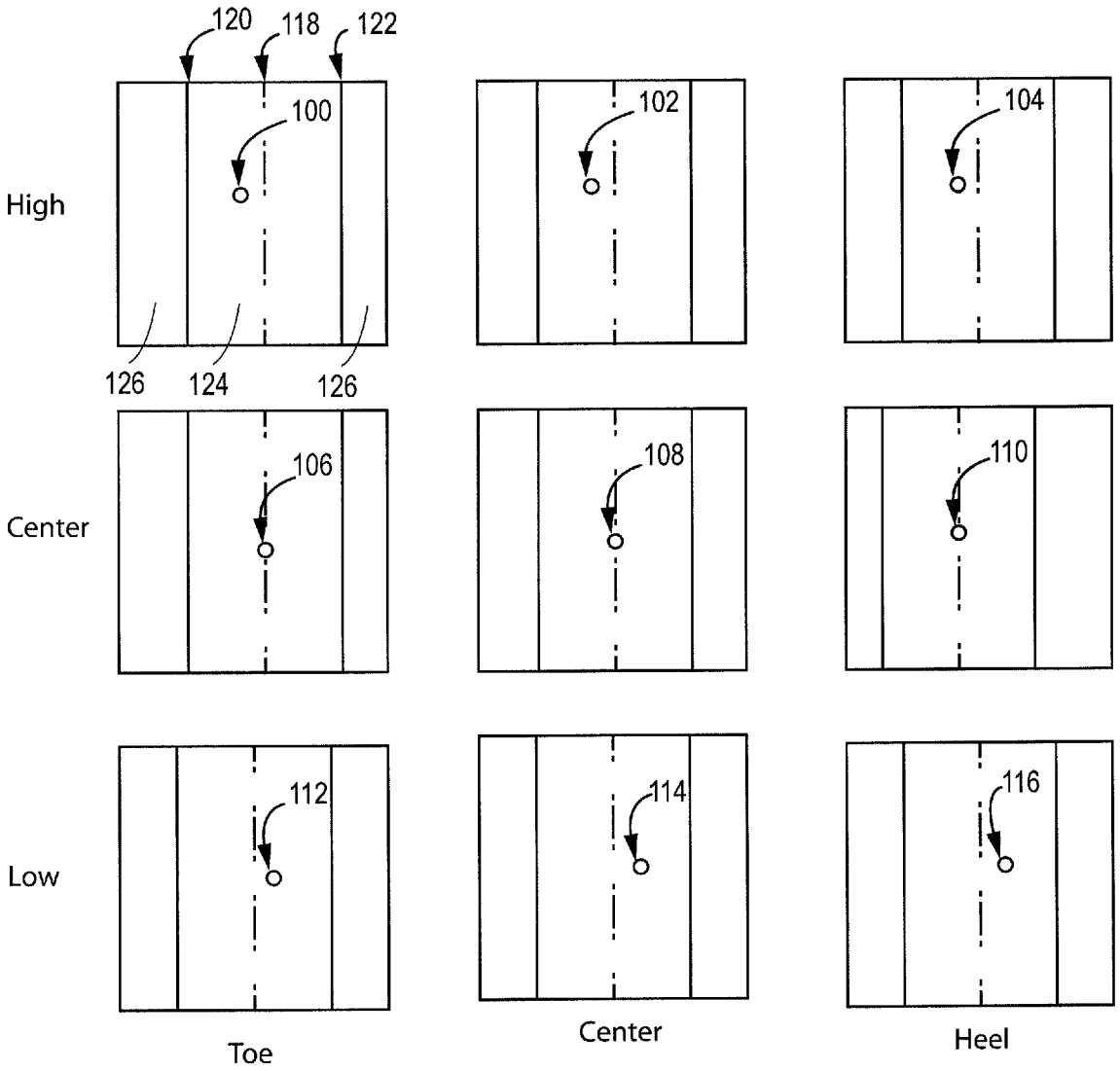
FIG. 1 is an illustration of different ball locations relative to the impact location on a golf club face.
Figure 2A:
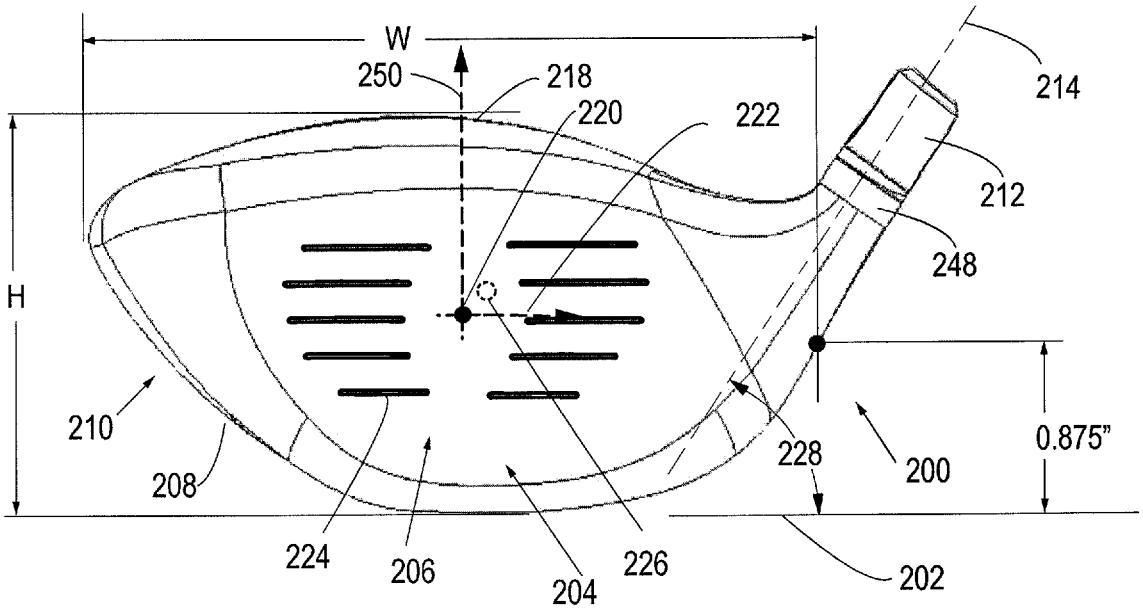
FIG. 2*a* is an elevated front view of a golf club head.

FIG. 2*a* illustrates a golf club head having a front portion 204, a heel portion 200, a toe portion 210, a crown portion 218, a hosel portion 248, a sole portion 208, a hosel axis 214, a lie angle 228, and a hosel insert 212. The golf club head has a width dimension W, a height dimension H, and a depth dimension D measured when the golf club head is positioned in an address position. The address position is defined as the golf club head in a lie angle of fifty-seven degrees and the loft of the club adjusted to the designated loft of the club head. Unless otherwise stated, all the measured dimensions described herein are evaluated when the club head is oriented in the address position. If the club head at a fifty-seven degree lie angle visually appears to be unlevel from a front face perspective, an alternative lie angle called the "scoreline lie" may be used. The scoreline lie is defined as the lie angle at which the substantially horizontal face scorelines are parallel to a perfectly flat ground plane. The width dimension W is not greater than 5 inches, and the depth dimension D is not greater than the width dimension W. The height dimension H is not greater than 2.8 inches. In some embodiments, the depth dimension D or the width dimension W is less than 4.4", less than 4.5", less than 4.6", less than 4.7", less than 4.8", less than 4.9", or less than 5". In some embodiments the height dimension H is less than 2.7", less than 2.6", less than 2.5", less than 2.4", less than 2.3", less than 2.2", less than 2.1", less than 2", less than 1.9" or less than 1.8". In certain embodiments, the club head height is between about 63.5 mm to 71 mm (2.5" to 2.8") and the width is between about 116.84 mm to about 127 mm (4.6" to 5.0"). Furthermore, the depth dimension is between about 111.76 mm to about 127 mm (4.4" to 5.0").

These dimensions are measured on horizontal lines between vertical projections of the outermost points of the heel and toe, face and back, and sole and crown. The outermost point of the heel is defined as the point on the heel that is 0.875" above the horizontal ground plane 202.

FIG. 2*a* further illustrates a face center 220 location. This location is found by utilizing the USGA Procedure for Measuring the Flexibility of a Golf Clubhead, Revision 2.0 published on Mar. 25, 2005, herein incorporated by reference in its entirety. Specifically, the face center 220 location is found by utilizing the template method described in section 6.1.4 and FIG. 6.1 described in the USGA document mentioned above.

A coordinate system for measuring CG location is located at the face center 220. In one embodiment, the positive x-axis 222 is projecting toward the heel side of the club head, the positive z-axis 250 is projecting toward the crown side of the club head, and the positive y-axis 216 is projecting toward the rear of the club head parallel to a ground plane.

In some embodiments, the golf club head can have a CG with a CG x-axis coordinate between about −5 mm and about 10 mm, a CG y-axis coordinate between about 15 mm and about 50 mm, and a CG z-axis coordinate between about −10 mm and about 5 mm. In yet another embodiment, the CG y-axis coordinate is between about 20 mm and about 50 mm.

Scorelines 224 are located on the striking face 206. In one exemplary embodiment, a projected CG location 226 is shown on the striking face and is considered the "sweet spot" of the club head. The projected CG location 226 is found by balancing the clubhead on a point. The projected CG location 226 is generally projected along a line that is perpendicular to the face of the club head. In some embodiments, the projected CG location 226 is less than 2 mm above the center face location, less than 1 mm above the center face, or up to 1 mm or 2 mm below the center face location 220.

Figure 2B:
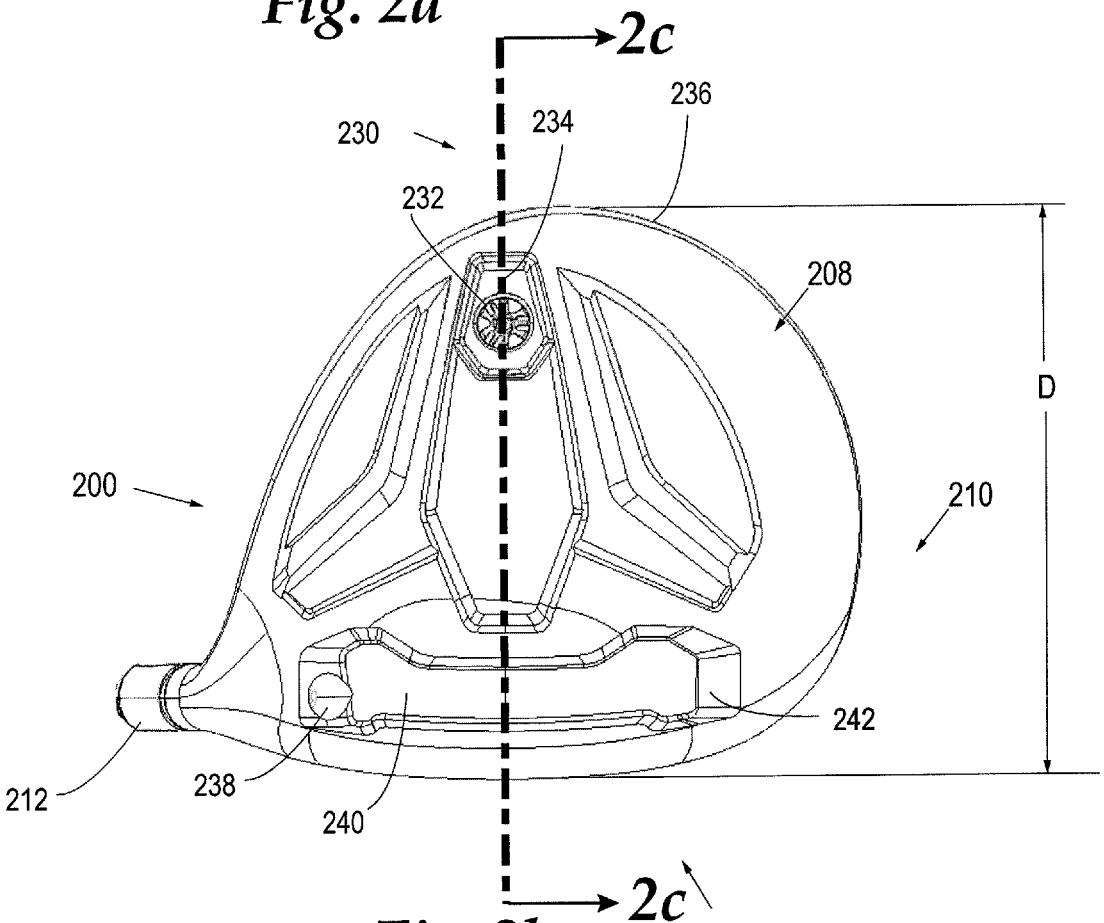
FIG. 2*b* is a sole view of a golf club head.

FIG. 2*b* illustrates a sole view of the club head showing the back portion 230 and an edge 236 between the crown 218 and sole 208 portions. In one embodiment, the club is provided with a weight port 234 and an adjustable weight 232 located in the weight port 234. In addition, a flexible recessed channel portion 240 having a channel sidewall 242 is provided in the front half of the club head sole portion 208 proximate to the striking face 206. Within the channel portion 240, a fastener opening 238 is provided to allow the insertion of a fastening member 268, such as a screw, for engaging with the hosel insert 212 for attaching a shaft to the club head and to allow for an adjustable loft, lie, and/or face angle. In one embodiment, the hosel insert 212 is configured to allow for the adjustment of at least one of a loft, lie or face angle.

Figure 2C:
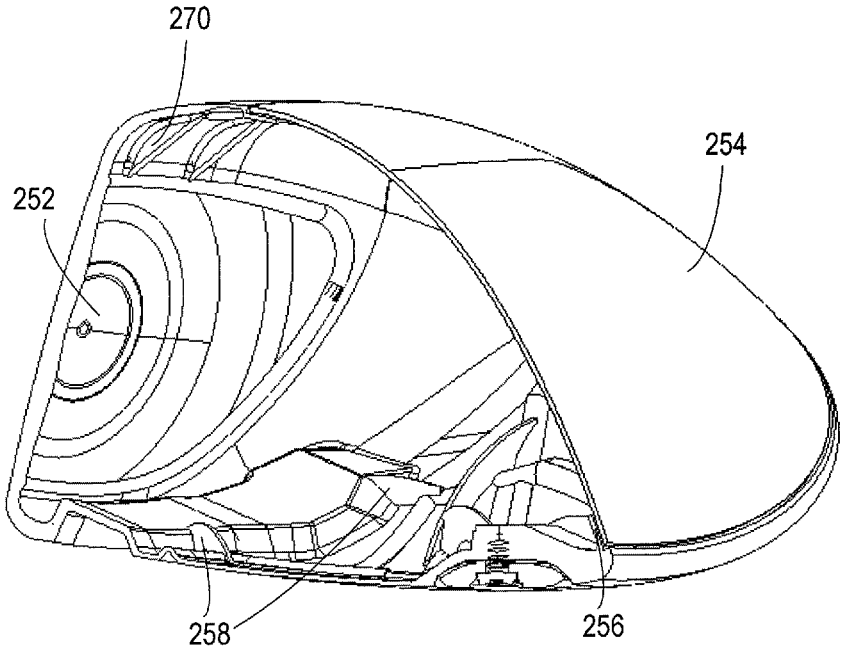
FIG. 2*c* is an isometric cross-sectional view taken along section lines 2*c*-2*c* in FIG. 2*b*.

FIG. 2*c* illustrates a cross-sectional view taken along lines 2*c*-2*c* in FIG. 2*b*. In one embodiment, a machined face insert 252 is welded to a front opening on the club head. The face insert 252 has a variable face thickness having an inverted recess in the center portion of the back surface of the face insert 252. In addition, a composite crown 254 is bonded to the crown portion 218 and rests on a bonding ledge 256. In one embodiment, the bonding ledge is between 1-7 mm, 1-5 mm, or 1-3 mm and continuously extends around a circumference of the opening to support the crown. A plurality of ribs 258 are connected to the interior portion of the channel 240 to improve the sound of the club upon impact with a golf ball.

Figure 2D:
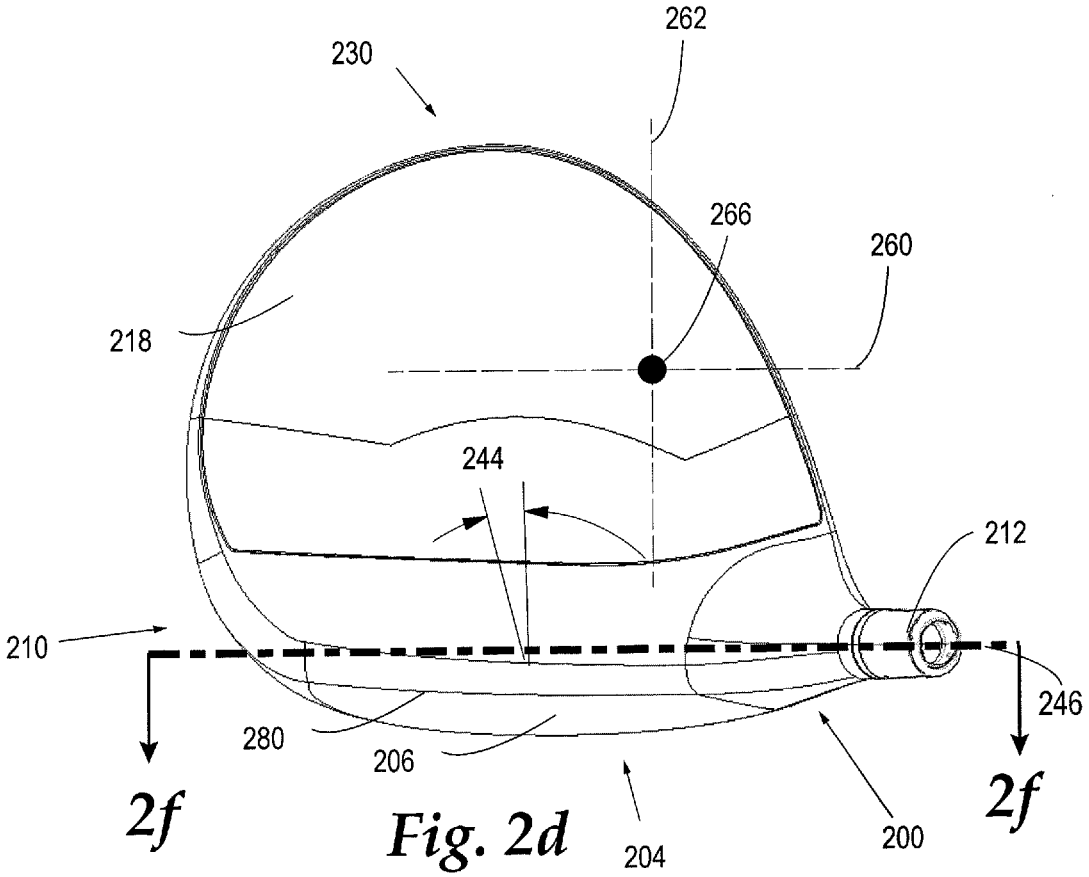
FIG. 2*d* is a top view of a golf club head.

FIG. 2*d* illustrates a top view of the golf club head in the address position. A hosel plane 246 is shown being perpendicular to the ground plane and containing the hosel axis 214. In addition, a center face nominal face angle 244 is shown which can be adjusted by the hosel insert 212. A positive face angle indicates the golf club face is pointed to the right of a center line target at a given measured point. A negative face angle indicates the golf club face is pointed to the left of a centerline target at a given measured point. A topline 280 is also shown. The topline 280 is defined as the intersection of the crown and the face of the golf club head. Often the paint line of the crown stops at the topline 280.

FIG. 2*d* also shows golf club head moments of inertia defined about three axes extending through the golf club head CG 266 including: a CG z-axis 264 (see FIG. 2*e*) extending through the CG 266 in a generally vertical direction relative to the ground 202 when the club head is at address position, a CG x-axis 260 extending through the CG 266 in a heel-to-toe direction generally parallel to the striking surface 206 and generally perpendicular to the CG z-axis 264, and a CG y-axis 262 extending through the CG 266 in a front-to-back direction and generally perpendicular to the CG x-axis 260 and the CG z-axis 264. The CG x-axis 260 and the CG y-axis 262 both extend in a generally horizontal direction relative to the ground 202 when the club head 200 is at the address position.

The moment of inertia about the golf club head CG x-axis 260 is calculated by the following equation:

$$I_{CGx}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CG x-axis 260 and the CG z-axis 264. The CG xy-plane is a plane defined by the CG x-axis 260 and the CG y-axis 262.

Moreover, a moment of inertia about the golf club head CG z-axis 264 is calculated by the following equation:

$$I_{CGx}=\int(x^2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis 262 and the CG z-axis 264.

In certain implementations, the club head can have a moment of inertia about the CG z-axis, between about 450 kg·mm2 and about 650 kg·mm2, and a moment of inertia about the CG x-axis between about 300 kg·mm2 and about 500 kg·mm2, and a moment of inertia about the CG y-axis between about 300 kg·mm2 and about 500 kg·mm2.

Figure 2E:
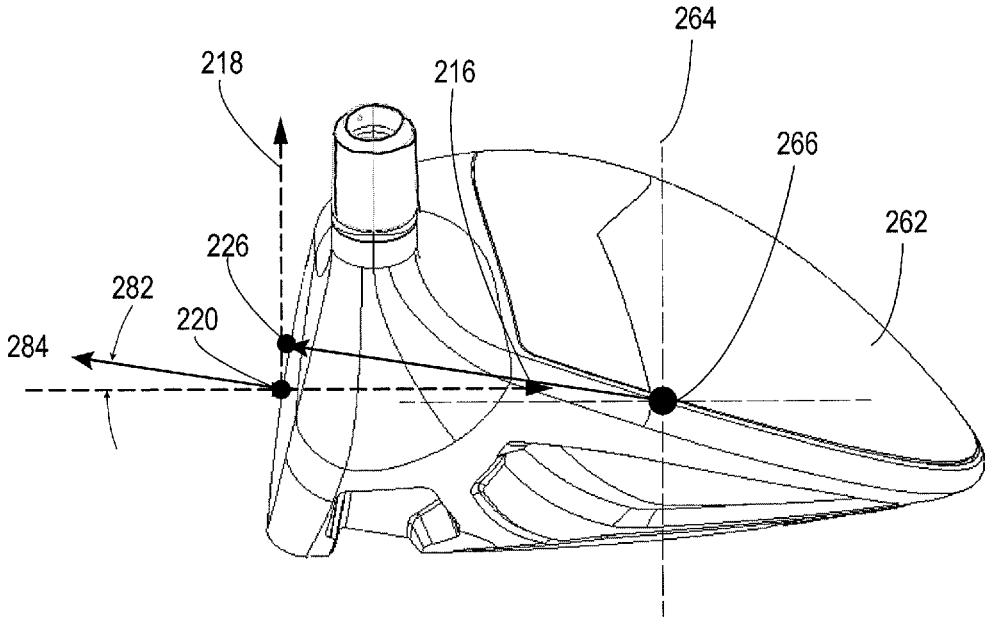
FIG. 2*e* is an elevated heel perspective view of a golf club head.

FIG. 2*e* shows the heel side view of the club head and provides a side view of the positive y-axis 216 and how the CG 266 is projected onto the face at a projected CG location 226 previously described. A nominal center face loft angle 282 is shown to be the angle created by a perpendicular center face vector 284 relative to a horizontal plane parallel to a ground plane.

Figure 2F:
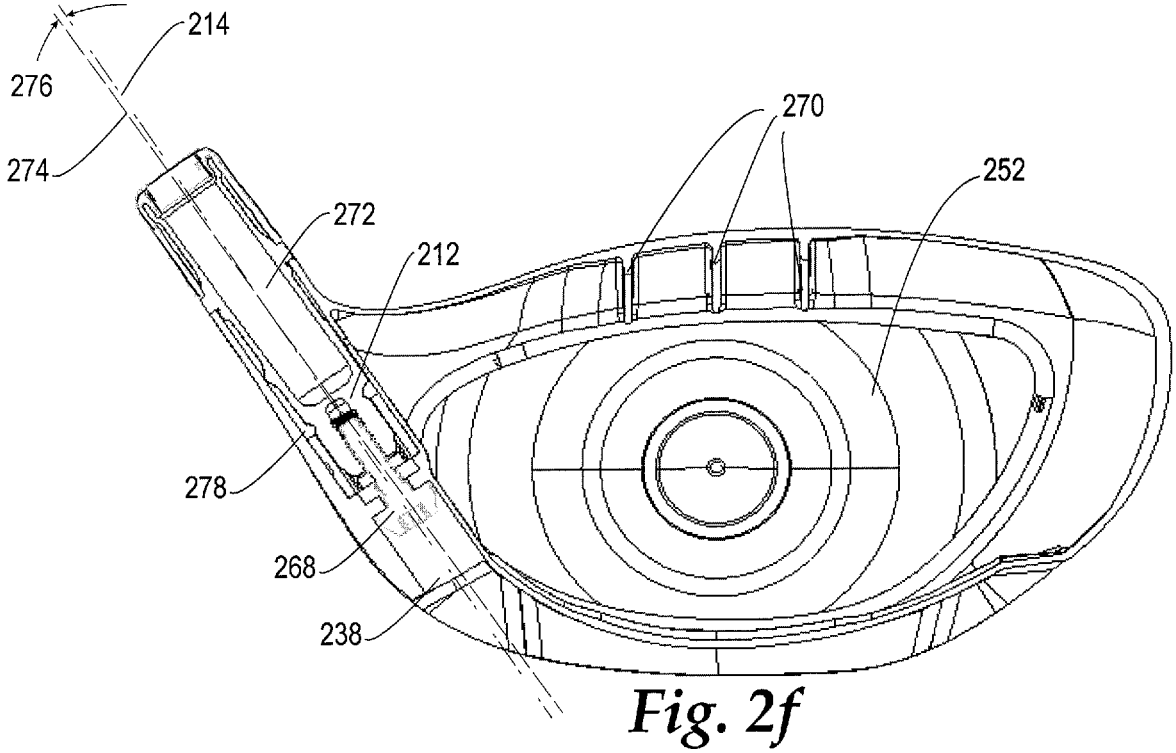
FIG. 2*f* is a cross-sectional view taken along section lines 2*f*-2*f* in FIG. 2*d*.

FIG. 2*f* illustrates a cross-sectional view taken along lines 2*f*-2*f* shown in FIG. 2*d*. The mechanical fastener 268 is more easily seen being inserted into the opening 238 for threadably engaging with the sleeve 212. The sleeve includes a sleeve bore 272 for allowing the shaft to be inserted for adhesive bonding with the sleeve 212. A plurality of crown ribs 270 are also shown in the face to crown transition portion.

Figure 3:
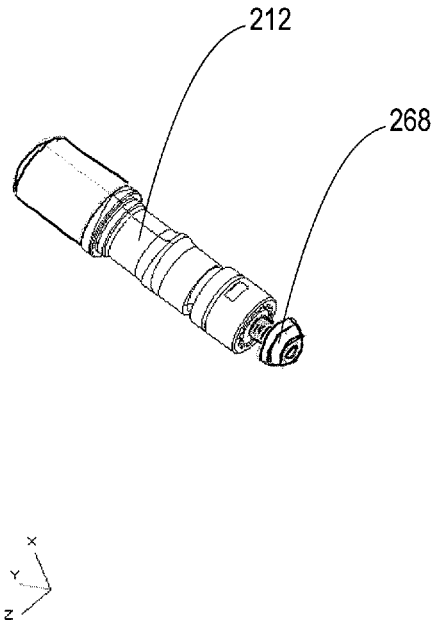
FIG. 3 is an isometric view of a shaft tip sleeve.

FIG. 3 illustrates the sleeve 212 and mechanical fastener 268 when removed from the golf club head. The embodiments described above include an adjustable loft, lie, or face angle system that is capable of adjusting the loft, lie, or face angle either in combination with one another or independently from one another. For example, a portion of the sleeve 212, the sleeve bore 272, and the shaft collectively define a longitudinal axis 274 of the assembly. In one embodiment, the longitudinal axis 274 of the assembly is co-axial with the sleeve bore 272. A portion of the hosel sleeve is effective to support the shaft along the longitudinal axis 274 of the assembly, which is offset from a longitudinal axis 214 of the interior hosel tube bore 278 by offset angle 276. The longitudinal axis 214 is co-axial with the interior hosel tube bore 278. The sleeve can provide a single offset angle that can be between 0 degrees and 4 degrees, in 0.25 degree increments. For example, the offset angle can be 1.0 degree, 1.25 degrees, 1.5 degrees, 1.75 degrees, 2.0 degrees, 2.25 degrees, 2.5 degrees, 2.75 degrees, or 3.0 degrees. The offset angle of the embodiment shown in FIG. 2*f* is 1.5 degrees.

Figure 4A:
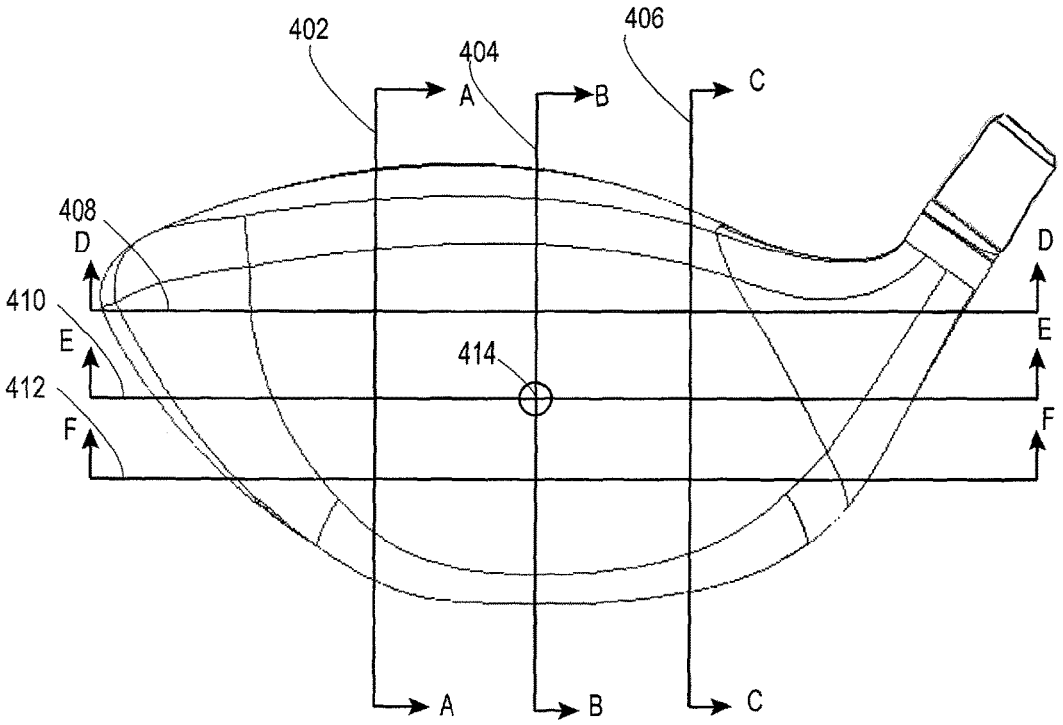
FIG. 4*a* is an elevated front view of a golf club according to an embodiment.

FIG. 4*a* illustrates a plurality of vertical planes 402,404, 406 and horizontal planes 408,410,412. More specifically, the toe side vertical plane 402, center vertical plane 404 (passing through center face), and heel vertical plane 406 are separated by a distance of 30 mm as measured from the center face location 414. The upper horizontal plane 408, the center horizontal plane 410 (passing through center face 414), and the lower horizontal plane 412 are spaced from each other by 15 mm as measured from the center face location 414.

Figure 4B:
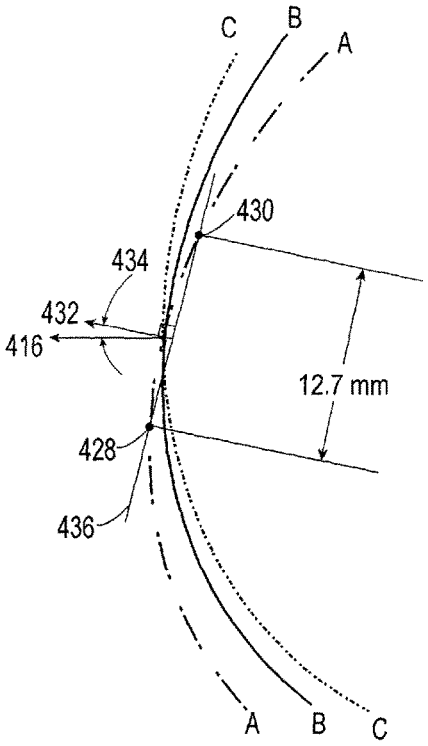
FIG. 4*b* is an exaggerated comparative view of face surface contours taken along section lines A-A, B-B, and C-C as seen from a heel view.

FIG. 4*b* illustrates all three striking face surface roll contours A,B,C that are overlaid on top of one another as viewed from the heel side of the golf club. The three face surface contours are defined as face contours that intersect the three vertical planes 402,404, 406. Specifically, toe side contour A, represented by a dashed line, is defined by the intersection of the striking face surface and vertical plane 402 located on the toe side of the striking face. Center face vertical contour B, represented by a solid line, is defined by the intersection of the striking face surface and center face vertical plane 404 located at the center of the striking face. Heel side contour C, represented by a finely dashed line, is defined by the intersection of the striking face surface a vertical plane 406 located on the heel side of the striking face. Roll contours A,B,C are considered three different roll contours across the striking face taken at three different locations to show the variability of roll across the face. The toe side vertical contour A is more lofted (having positive LA°Δ) relative to the center face vertical contour B. The heel side vertical contour C is less lofted (having a negative LA°Δ) relative to the center face vertical contour B.

FIG. 4*b* shows a loft angle change 434 that is measured between a center face vector 416 located at the center face 414 and the toe side roll curvature A having a face angle vector 432. The vertical pin distance of 12.7 mm is measured along the toe side roll curvature A from a center location to a crown side and a sole side to locate a crown side measurement 430 point and sole side measurement points 428. A segment line 436 connects the two points of measurement. A loft angle vector 432 is perpendicular to the segment line 436. The loft angle vector 432 creates a loft angle 434 with the center face vector 416 located at the center face point 414. As described, a more lofted angle indicates that the loft angle change (LA°Δ) is positive relative to the center face vector 416 and points above or higher relative to the center face vector 416 as is the case for the roll curvature A.

Figure 4C:
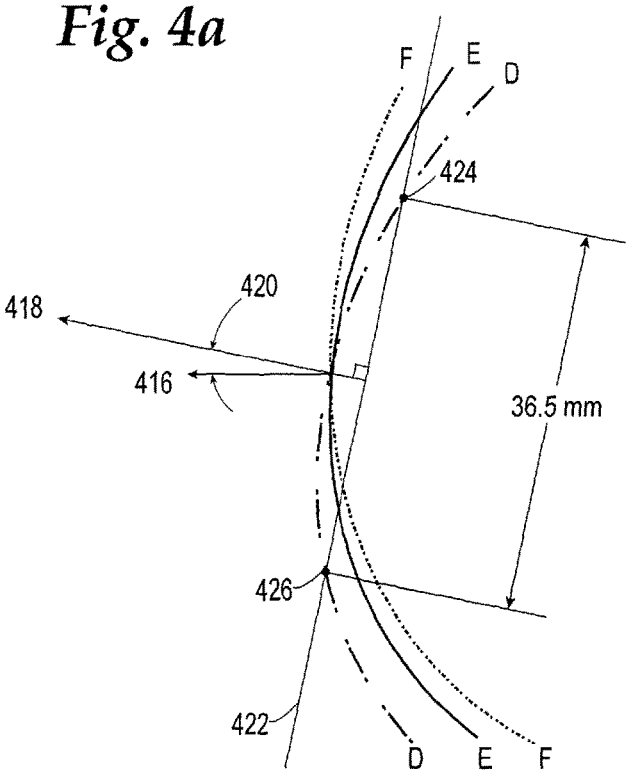
FIG. 4*c* is an exaggerated comparative view of face surface contours taken along section lines D-D, E-E, and F-F as seen from a top view.

FIG. 4*c* further illustrates three striking face surface bulge contours D,E,F that are overlaid on top of one another as viewed from the crown side of the golf club. The three face surface contours are defined as face contours that intersect the three horizontal planes 408,410, 412. Specifically, crown side contour D, represented by a dashed line, is defined by the intersection of the striking face surface and upper horizontal plane 408 located on the upper side of the striking face toward the crown portion. Center face contour E, represented by a solid line, is defined by the intersection of the striking face surface and horizontal plane 408 located at the center of the striking face. Sole side contour F, represented by a finely dashed line, is defined by the intersection of the striking face surface a horizontal plane 412 located on the lower side of the striking face. Bulge contours D,E,F are considered three different bulge contours across the striking face taken at three different locations to show the variability of bulge across the face. The crown side bulge contour D is more open (having a positive FA°Δ, defined below) when compared to the center face bulge contour E. The sole side bulge contour F is more closed (having a negative FA°Δ when measured about the center vertical plane).

With the type of "twisted" bulge and roll contour defined above, a ball that is struck in the upper portion of the face will be influenced by horizontal contour D. A typical shot having an impact in the upper portion of a club face will influence the golf ball to land left of the intended target. However, when a ball impacts the "twisted" face contour described above, horizontal contour D provides a general curvature that points to the right to counter the left tendency of a typical upper face shot.

Likewise, a typical shot having an impact location on the lower portion of the club face will land typically land to the right of the intended target. However, when a ball impacts the "twisted" face contour described above, horizontal contour F provides a general curvature that points to the left to counter the right tendency of a typical lower face shot. It is understood that the contours illustrated in FIGS. 4*b* and 4*c* are severely distorted in order for explanation purposes.

In order to determine whether a 2-D contour, such as A,B,C,D,E, or F, is pointing left, right, up, or down, two measurement points along the contour can be located 18.25 mm from a center location or 36.5 mm from each other. A first imaginary line can be drawn between the two measurement points. Finally, a second imaginary line perpendicular to the first imaginary line can be drawn. The angle between the second imaginary line of a contour relative to a line perpendicular to the center face location provides an indication of how open or closed a contour is relative to a center face contour. Of course, the above method can be implemented in measuring the direction of a localized curvature provided in a CAD software platform in a 3D or 2D model, having a similar outcome. Alternatively, the striking surface of an actual golf club can be laser scanned or profiled to retrieve the 2D or 3D contour before implementing the above measurement method. Examples of laser scanning devices that may be used are the GOM Atos Core 185 or the Faro Edge Scan Arm HD. In the event that the laser scanning or CAD methods are not available or unreliable, the face angle and the loft of a specific point can be measured using a "black gauge" made by Golf Instruments Co. located in Oceanside, Calif. An example of the type of gauge that can be used is the M-310 or the digital-manual combination C-510 which provides a block with four pins for centering about a desired measurement point. The horizontal distance between pins is 36.5 mm while the vertical distance between the pins is 12.7 mm.

When an operator is measuring a golf club with a black gauge for loft at a desired measurement point, two vertical pins (out of the four) are used to measure the loft about the desired point that is equidistant between the two vertical pins that locate two vertical points. When measuring a golf club with a black gauge for face angle at a desired measurement point, two horizontal pins (out of the four) are used to measure the face angle about the desired point. The desired point is equidistant between the two horizontal points located by the pins when measuring face angle.

FIG. 4*c* shows a face angle 420 that is measured between a center face vector 416 located at the center face 414 and the crown side bulge curvature D having a face angle vector 418. The horizontal pin distance of 18.25 mm is measured along the crown side bulge curvature D from a center location to a heel side and a toe side to locate a heel side measurement 426 point and toe side measurement points 424. A segment line 422 connects the two points of measurement. A face angle vector 418 is perpendicular to the segment line 422. The face angle vector 418 creates a face angle 420 with the center face vector 416 located at the center face point 414. As described, an open face angle indicates that the face angle change (FA°Δ) is positive relative to the center face vector 416 and points to the right as is the case for the bulge curvature D.

Figure 5:
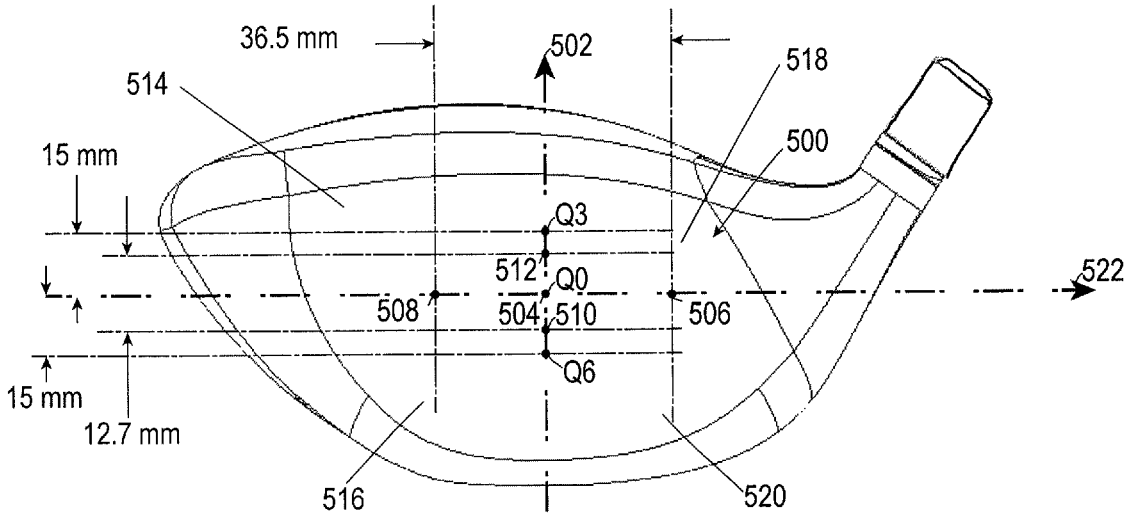
FIG. 5 is a front view of a golf club face with multiple measurement points and four quadrants.

FIG. 5 shows a desired measurement point Q0 located at the center of the striking face 500. A horizontal plane 522 and a vertical plane 502 intersect at the desired measurement point Q0 and divide the striking face 500 into four quadrants. The upper toe quadrant 514, the upper heel quadrant 518, the lower heel quadrant 520, and the lower toe quadrant 516 all form the striking face 500, collectively. In one embodiment, the upper toe quadrant 514 is more "open" than all the other quadrants. In other words, the upper toe quadrant 514 has a face angle pointing to the right, in the aggregate. In other words, if a plurality of evenly spaced points (for example a grid with measurement points being spaced from one another by 5 mm) covering the entire upper toe quadrant 514 were measured, it would have an average face angle that points right of the intended target more than any other quadrant.

The term "open" is defined as having a face angle generally pointing to the right of an intended target at address, while the term "closed" is defined as having a face angle generally pointing to the left of an intended target ad address. In one embodiment, the lower heel quadrant 520 is more "closed" than all the other quadrants, meaning it has a face angle, in the aggregate, that is pointing more left than any of the other quadrants.

If the edge of the striking surface 500 is not visually clear, the edge of the striking face 500 is defined as a point at which the striking surface radius becomes less than 127 mm. If the radius is not easily computed within a computer modeling program, three points that are 0.1 mm apart can be used as the three points used for determining the striking surface radius. A series of points will define the outer perimeter of the striking face 500. Alternatively, if a radius is not easily obtainable in a computer model, a 127 mm curvature gauge can be used to detect the edge of the face of an actual golf club head. The curvature gauge would be rotated about a center face point to determine the face edge.

In one illustrative example in FIG. 5, the face angle and loft are measured for a center face point Q0 when an easily measurable computer model method is not available, for example, when an actual golf club head is measured. A black gauge is utilized to measure the face angle by selecting two horizontal points 506,508 along the horizontal plane 522 that are 36.5 mm apart and centered about the center face point Q0 so that the horizontal points 506,508 are equidistant from the center face point Q0. The two pins from the black gauge engage these two points and provide a face angle measurement reading on the angle measurement readout provided. Furthermore, a loft is measured about the Q0 point by selecting two vertical points 512,510 that are spaced by a vertical distance of 12.7 mm apart from each other. The two vertical pins from the black gauge engage these two vertical points 512,510 and provide a loft angle measurement reading on the readout provided.

The positive x-axis 522 for face point measurements extends from the center face toward the heel side and is tangent to the center face. The positive y-axis 502 for face point measurements extends from the center face toward the crown of the club head and is tangent to the center face. The x-y coordinate system at center face, without a loft component, is utilized to locate the plurality of points P0-P36 and Q0-Q8, as described below. The positive z-axis 504 extends from the face center and is perpendicular to the face center point and away from the internal volume of the club head. The positive z-axis 504 and positive y-axis 502 will be utilized as a reference axis when the face angle and loft angle are measured at another x-y coordinate location, other than center face.

FIG. 5 further shows two critical points Q3 and Q6 located at coordinates (0 mm,15 mm) and (0 mm,−15 mm), respectively. As used herein, the terms "1° twist" and "2° twist" are defined as the total face angle change between these two critical point locations at Q3 and Q6. For example, a "1° twist" would indicate that the Q3 point has a 0.5° twist relative to the center face, Q0, and the Q6 point has a −0.5° twist relative to the center face, Q0. Therefore, the total degree of twist as an absolute value between the critical points Q3,Q6 is 1°, hence the nomenclature "1° twist".

Figure 6A:
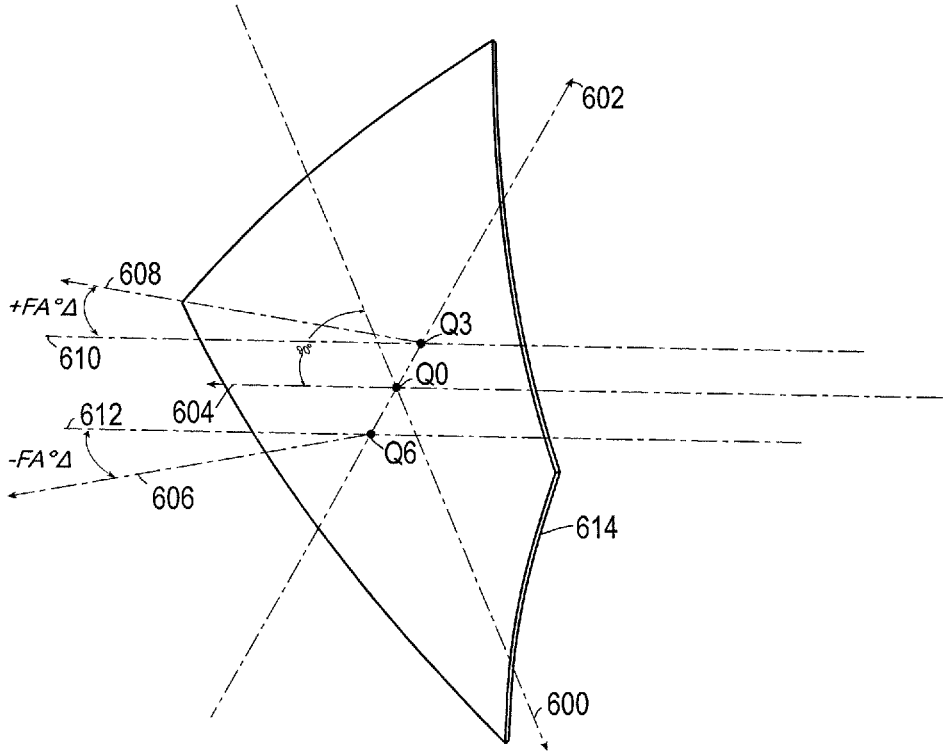
FIG. 6*a* is an isometric view of an exemplary twisted face surface plane.

To further the understanding of what is meant by a "twisted face", FIG. 6*a* provides an isometric view of an over-exaggerated twisted striking surface plane 614 of "10° twist" to illustrate the concept as applied to a golf club striking face. Each point located on the golf club face has an associated loft angle change (defined as "LA°Δ") and face angle change (defined as "FA°Δ"). Each point has an associated loft angle change (defined as "LA°Δ") and face angle change (defined as "FA°Δ").

FIG. 6*a* shows the center face point, Q0, and the two critical points Q3,Q6 described above, and a positive x-axis 600, positive z-axis 604, and positive y-axis 602 located on a twisted plane in an isometric view. The center face has a perpendicular axis 604 that passes through the center face point Q0 and is perpendicular to the twisted plane 614 Likewise, the critical points Q3 and Q6 also have a reference axis 610, 612 which is parallel to the center face perpendicular axis 604. The reference axes 610, 612 are utilized to measure a relative face angle change and loft angle change at these critical point locations. The critical points Q3, Q6 each have a perpendicular axis 608, 606 that is perpendicular to the face. Thus, the face angle change is defined at the critical points as the change in face angle between the reference axis 610,612 and the relative perpendicular axis 608, 606.

Figure 6B:
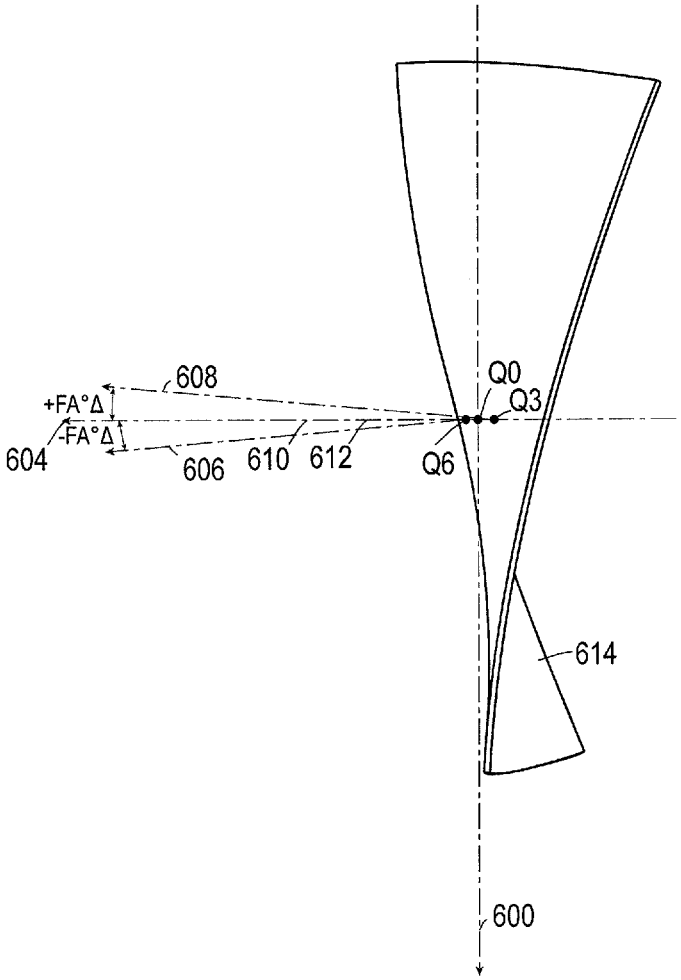
FIG. 6*b* is a top view of an exemplary twisted face surface plane.

FIG. 6*b* shows a top view of the twisted plane 614 and further illustrates how the face angle change is measured between the perpendicular axes 608, 606 at the critical points and the reference axes 610, 612 that are parallel with the center face perpendicular axis 604. A positive face angle change +FA°Δ indicates a perpendicular axis at a measured point that points to the right of the relative reference axis. A negative face angle change −FA°Δ indicates a perpendicular axis that points to the left of the relative reference axis. The face angle change is measured within the plane created by the positive x-axis 600 and positive z-axis 604.

Figure 6C:
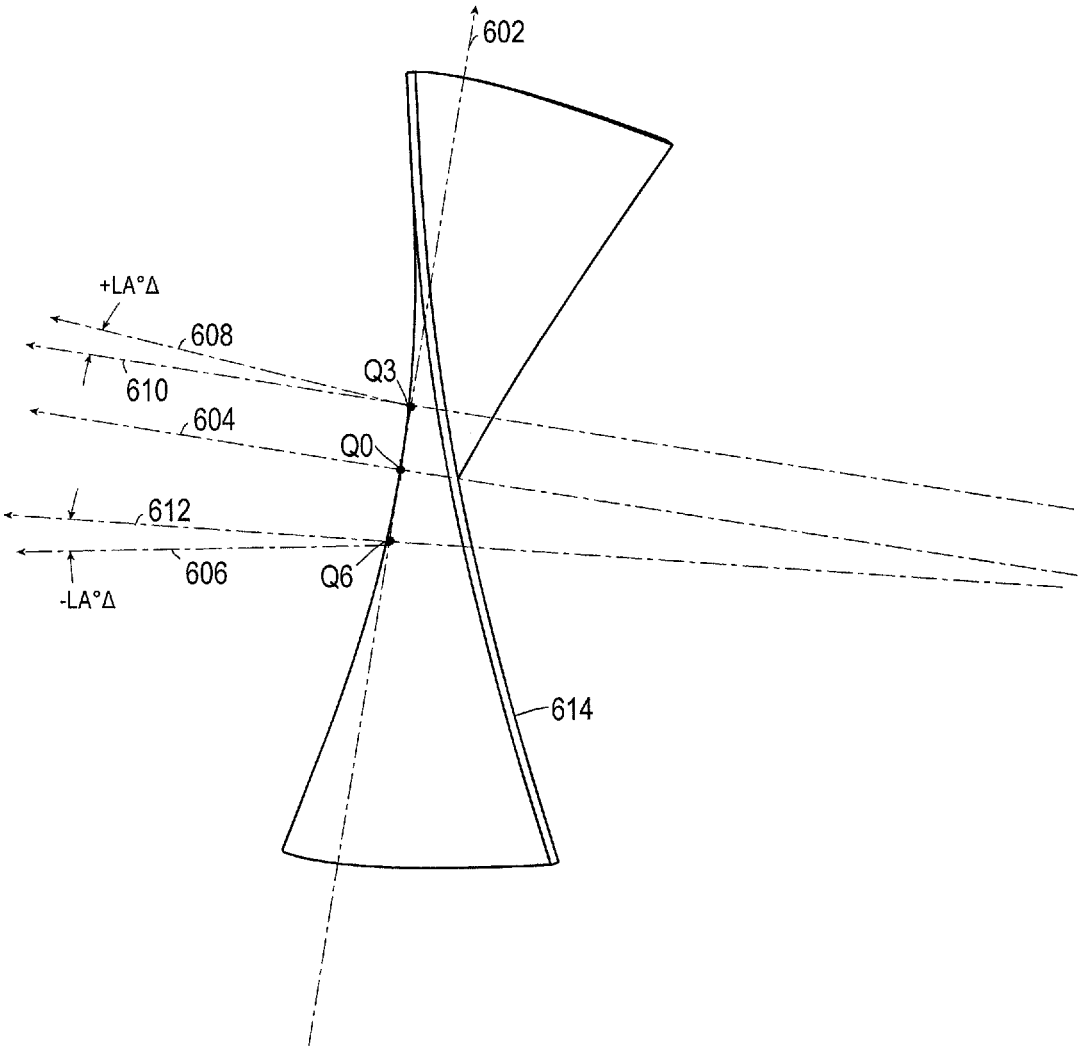
FIG. 6*c* is an elevated heel view of an exemplary twisted face surface plane.

FIG. 6*c* shows a heel side view of a twisted plane 614 and the loft angle change between the perpendicular axes 608, 606 and the reference axes 610,612 at the critical point locations. A positive loft angle change +LA°Δ indicates a perpendicular axis at a measured point that points above the relative reference axis. A negative loft angle change −LA°Δ indicates a perpendicular axis that points below the relative reference axis. The loft angle is measured within the plane created by the positive z-axis 604 and positive y-axis 602 for a given measured point.

Figure 7:
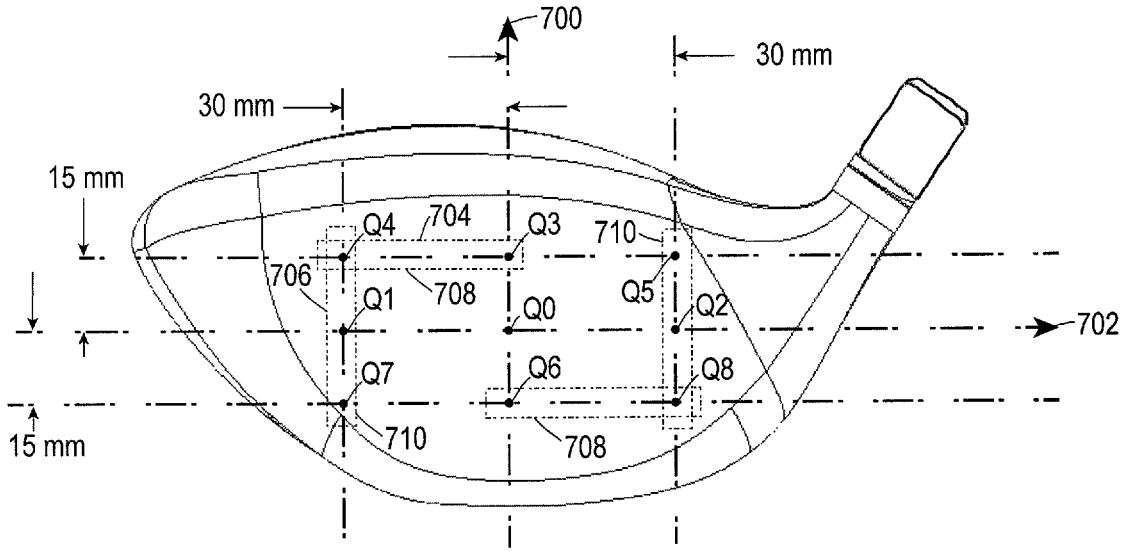
FIG. 7 illustrates a front view of a golf club with a predetermined set of measurement points.

FIG. 7 shows an additional plurality of points Q0-Q8 that are spaced apart across the striking face in a grid pattern. In addition to the critical points Q3,Q6 described above, heel side points Q5,Q2,Q8 are spaced 30 mm away from a vertical axis 700 passing through the center face. Toe side points Q4,Q1,Q7 are spaced 30 mm away from the vertical axis 700 passing through the center face. Crown side points Q3,Q4,Q5 are spaced 15 mm away from a horizontal axis 702 passing through the center face. Sole side points Q6,Q7, Q8 are spaced 15 mm away from the horizontal axis 702. Point Q5 is located in an upper heel quadrant at a coordinate location (30 mm, 15 mm) while point Q7 is located in a lower toe quadrant at a coordinate location (−30 mm, −15 mm). Point Q4 is located in an upper toe quadrant at a coordinate location (−30 mm, 15 mm) while point Q8 is located in a lower heel quadrant at a coordinate location (30 mm, −15 mm).

It is understood that many degrees of twist are contemplated and the embodiments described are not limiting. For example, a golf club having a "0.25° twist", "0.75° twist", "1.25° twist", "1.5° twist","1.75° twist", "2.25° twist", "2.5° twist", "2.75° twist, "3° twist", "3.25° twist", "3.5° twist", "3.75° twist", "4.25° twist", "4.5° twist", "4.75° twist", "5° twist", "5.25° twist", "5.5° twist", "5.75° twist", "6° twist", "6.25° twist", "6.5° twist", "6.75° twist", "7° twist", "7.25° twist", "7.5° twist", "7.75° twist", "8° twist", "8.25° twist", "8.5° twist", "8.75° twist", "9° twist", "9.25° twist", "9.5° twist", "9.75° twist", and "10° twist" are considered other possible embodiments of the present invention. A golf club having a degree of twist greater than 0°, between 0.25° and 5°, between 0.1° and 5°, between 0° and 5°, between 0° and 10°, or between 0° and 20° are contemplated herein.

Utilizing the grid pattern of FIG. 7, a plurality of embodiments having a nominal center face loft angle of 9.5°, a bulge of 330.2 mm, and a roll of 279.4 mm were analyzed having a "0.5° twist", "1° twist", "2° twist", and "4° twist". A comparison club having "0° twist" is provided for reference in contrast to the embodiments described.

Table 1 shows the LA°Δ and FA°Δ relative to center face for points located along the vertical axis 700 and horizontal axis 702 (for example points Q1,Q2, Q3, and Q6). With regard to points located away from the vertical axis 700 and horizontal axis 702, the LA°Δ and FA°Δ are measured relative to a corresponding point located on the vertical axis 700 and horizontal axis 702, respectively.

For example, regarding point Q4, located in the upper toe quadrant of the golf club head at a coordinate of (−30 mm, 15 mm), the LA°Δ is measured relative to point Q3 having the same vertical axis 700 coordinate at (0 mm, 15 mm). In other words, both Q3 and Q4 have the same y-coordinate location of 15 mm. Referring to Table 1, the LA°Δ of point Q4 is 0.4° with respect to the loft angle at point Q3. The LA°Δ of point Q4 is measured with respect to point Q3 which is located in a corresponding upper toe horizontal band 704.

In addition, regarding point Q4, located in the upper toe quadrant of the golf club head at a coordinate of (−30 mm, 15 mm), the FA°Δ is measured relative to point Q1 having the same horizontal axis 702 coordinate at (−30 mm, 0 mm). In other words, both Q1 and Q4 have the same x-coordinate location of −30 mm. Referring to Table 1, the FA°Δ of point Q4 is 0.2° with respect to the face angle at point Q1. The FA°Δ of point Q4 is measured with respect to point Q1 which is located in a corresponding upper toe vertical band 706. To further illustrate how LA°Δ and FA°Δ are calculated for points located within a quadrant that are away from a vertical or horizontal axis, the LA°Δ of point Q8 is measured relative to a loft angle located at point Q6 within a lower heel quadrant horizontal band 708. Likewise, the FA°Δ of point Q8 is measured relative to a face angle located at point Q2 within a lower heel quadrant vertical band 710.

In summary, the LA°Δ and FA°Δ for all points that are located along either a horizontal 702 or vertical axis 700 are measured relative to center face Q0. For points located within a quadrant (such as points Q4, Q5, Q7, and Q8) the LA°Δ is measured with respect to a corresponding point located in a corresponding horizontal band, and the FA°Δ of a given point is measured with respect to a corresponding point located in a corresponding vertical band. In FIG. 7, not all bands are shown in the drawing for the improved clarity of the drawing.

The reason that points located within a quadrant have a different procedure for measuring LA°Δ and FA°Δ is that this method eliminates any influence of the bulge and roll curvature on the LA°Δ and FA°Δ numbers within a quadrant. Otherwise, if a point located within a quadrant is measured with respect to center face, the LA°Δ and FA°Δ numbers will be dependent on the bulge and roll curvature. Therefore utilizing the horizontal and vertical band method of measuring LA°Δ and FA°Δ within a quadrant eliminates any undue influence of a specific bulge and roll curvature. Thus the LA°Δ and FA°Δ numbers within a quadrant should be applicable across any range of bulge and roll curvatures in any given head. The above described method of measuring LA°Δ and FA°Δ within a quadrant has been applied to all examples herein.

The relative LA°Δ and FA°Δ can be applied to any lofted driver, such as a 9.5°, 10.5°, 12° lofted clubs or other commonly used loft angles such as for drivers, fairway woods, hybrids, irons, or putters.

TABLE 1

| Relative to Center Face and Bands | | | | | | | | | | | | |
|---|---|---|---|---|---|---|---|---|---|---|---|---|
| | X-axis | Y-Axis | Example 1 0.5° twist | | Example 2 1° twist | | Example 3 2° twist | | Example 4 4° twist | | 0° twist | |
| Point | (mm) | (mm) | LA° Δ | FA°Δ | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 | 0 | 0 |
| Q1 | −30 | 0 | 0.5 | 5.7 | 1 | 5.7 | 2 | 5.6 | 4 | 5.6 | 0 | 5.7 |
| Q2 | 30 | 0 | −0.5 | −5.7 | −1 | −5.7 | −2 | −5.6 | −4 | −5.6 | 0 | −5.7 |
| Q3 | 0 | 15 | 3.4 | 0.25 | 3.4 | 0.5 | 3.4 | 1 | 3.4 | 2 | 3.4 | 0 |
| Q4 | −30 | 15 | 0.4 | 0.2 | 0.9 | 0.4 | 1.9 | 1 | 3.9 | 2 | 0 | 0 |
| Q5 | 30 | 15 | −0.5 | 0.3 | −1 | 0.5 | −2 | 0.9 | −4 | 1.9 | 0 | 0 |
| Q6 | 0 | −15 | −3.4 | −0.25 | −3.4 | −0.5 | −3.4 | −1 | −3.4 | −2 | −3.4 | 0 |
| Q7 | −30 | −15 | 0.5 | −0.3 | 1 | −0.5 | 2 | −0.9 | 4 | −2 | 0 | 0 |
| Q8 | 30 | −15 | −0.5 | −0.2 | −1 | −0.4 | −2 | −1 | −4.1 | −2 | 0 | 0 |

In Examples 1-4 of Table 1, the critical point Q3 has a LA°Δ of +3.4° with respect to the center face. In some embodiments, a LA°Δ at Q3 is between 0° and 7°, between 1° and 5°, between 2° and 4°, or between 3° and 4°. A FA°Δ of greater than zero at the critical point Q3 (15 mm above the center face) is shown. The FA°Δ at the critical point Q3 can be between 0° and 5°, between 0.1° and 4°, between 0.2° and 4°, or between 0.2° and 3°, in some embodiment. In addition, the critical point Q6 has a LA°Δ of −3.4°, or less than zero, with respect to the center face for Examples 1-4. In some embodiments, a LA°Δ at Q6 is between 0° and −7°, between −1° and −5°, between −2° and −4°, or between −3° and −4°. A FA°Δ of less than zero at the critical point Q6 (−15 mm below the center face) is shown. In some embodiments, the FA°Δ at the critical point Q6 can be between 0° and −5°, between −0.1° and −4°, between −0.2° and −4°, or between −0.2° and −3°. In Examples 1-4, the loft angle remains constant relative to center face at the critical points Q3,Q6 while the face angle changes relative to center face as the degree of twist is changed.

Examples 1-4 of Table 1 further show a heel side point Q2 located at a x-y coordinate (30 mm, 0 mm) where the LA°Δ relative to center is −0.5°, −1°, −2°, and −4°, respectively, for each example. Therefore, a LA°Δ of less than zero at the point Q2 is shown. In some embodiments, the LA°Δ at the Q2 point is between 0° and −8°. In addition, Examples 1-4 at Q2 show a FA°Δ of less than −4° relative to center face as the degree of twist gets larger. In some embodiments, the FA°Δ at Q2 is between −0.2° and −10°, between −0.3° and −9°, or between −1° and −8°.

Examples 1-4 of Table 1 further show a toe side point Q1 located at a coordinate (−30 mm, 0 mm) where the LA°Δ relative to center is 0.5°, 1°, 2°, and 4°, respectively. Therefore, a LA°Δ of greater than zero at the point Q1 is shown. In some embodiments, the LA°Δ at the Q1 point is between 0° and 8°, between 0.1° and 7°, between 0.2° and 6°, or between 0.3° and 5°. In addition, a FA°Δ at Q1 can be between 1° and 8°, between 2° and 7°, or between 3° and 6°.

Examples 1-4 of Table 1 further show at least one upper heel quadrant point Q5 having a FA°Δ relative to point Q2 that is greater than 0.1°, greater than 0.2° or 0.3°. For instance, at point Q5, Examples 1, 2, 3, and 4 show a FA°Δ relative to point Q2 of 0.3°, 0.5°, 0.9°, and 1.9°, respectively, which are all greater than 0.1°. Examples 1-4 of Table 1 also show at least one upper heel quadrant point Q5 having a LA°Δ relative to point Q3 that is less than −0.2°. For instance, at point Q5, Examples 1, 2, 3, and 4 show a LA°Δ relative to point Q3 of −0.5°, −1°, −2°, and −4°, respectively, which are all less than −0.1°, less than −0.3, or less than −0.4.

Examples 1-4 of Table 1 further show at least one upper toe quadrant point Q4 having a FA°Δ relative to point Q1 that is greater than 0.1°. For instance, at point Q5, Examples 1, 2, 3, and 4 show a FA°Δ relative to point Q1 of 0.2°, 0.4°, 1°, and 2°, respectively, which are all greater than 0.15°. Examples 1-4 of Table 1 also show at least one upper toe quadrant point Q4 having a LA°Δ relative to point Q1 that is greater than 0.1°. For instance, at point Q4, Examples 1, 2, 3, and 4 show a LA°Δ relative to point Q1 of 0.4°, 0.9°, 1.9°, and 3.9°, respectively, which are all greater than 0.2° or greater than 0.3°.

Examples 1-4 of Table 1 further show at least one lower heel quadrant point Q8 having a FA°Δ relative to point Q2 that is less than −5.7°. For instance, at point Q8, Examples 1, 2, 3, and 4 show a FA°Δ relative to point Q2 of −0.2°, −0.4°, −1°, and −2°, respectively, which are all less than −0.1°. Examples 1-4 of Table 1 also show at least one lower heel quadrant point Q8 having a LA°Δ relative to point Q6 that is less than −0.1°. For instance, at point Q8, Examples 1, 2, 3, and 4 show a LA°Δ relative to point Q6 of −0.5°, −1°, −2°, and −4.1°, respectively, which are all less than −0.2°, less than 0.3° or less than 0.4°.

Examples 1-4 of Table 1 further show at least one lower toe quadrant point Q7 having a FA°Δ relative to point Q1 that is less than −0.1°. For instance, at point Q7, Examples 1, 2, 3, and 4 show a FA°Δ relative to center of −0.3°, −0.5°, −0.9°, and −2°, respectively, which are all less than −0.2°. Examples 1-4 of Table 1 also show at least one lower heel quadrant point Q7 having a LA°Δ relative to point Q6 that is greater than 0.2°. For instance, at point Q7, Examples 1, 2, 3, and 4 show a LA°Δ relative to point Q6 of 0.5°, 1°, 2°, and 4°, respectively, which are all greater than 0.3° or greater than 0.4°.

Table 2 shows the same embodiments of Table 1 but provides the difference in LA°Δ and FA°Δ when compared to the golf club head with "0° twist" as the base comparison. Example 1 has up to +/−0.5° of LA°Δ and up to +/−0.3 FA°Δ when compared to the golf club head with "0° twist". Example 2 has up to +/−1° of LA°Δ and up to +/−0.5 FA°Δ when compared to the golf club head with "0° twist". Example 3 has up to +/−2° of LA°Δ and up to +/−1 FA°Δ when compared to the golf club head with "0° twist". Example 4 has up to +/−4.1° of LA°Δ and up to +/−2.1 FA°Δ when compared to the golf club head with "0° twist".

In Examples 1-4, the LA°Δ and FA°Δ relative to center face remains unchanged at the center face location (0 mm, 0 mm) when compared to the "0° twist" head. However, all other points away from the center face location in Examples 1-4 have some non-zero amount of either LA°Δ or FA°Δ.

TABLE 2

| Relative to Zero Degree Twist | | | | | | | | | | |
|---|---|---|---|---|---|---|---|---|---|---|
| | | | Example 1 0.5° twist | | Example 2 1° twist | | Example 3 2° twist | | Example 4 4° twist | |
| Point | X-axis (mm) | Y-Axis (mm) | LA°Δ | FA°Δ | LA°Δ | FA°Δ | LA°Δ | FA°Δ | LA°Δ | FA°Δ |
| Q0 | 0 | 0 | 0 | 0 | 0 | 0 | 0 | 0 | 0 | 0 |
| Q1 | −30 | 0 | 0.5 | 0 | 1 | 0 | 2 | −0.1 | 4 | −0.1 |
| Q2 | 30 | 0 | −0.5 | 0 | −1 | 0 | −2 | 0.1 | −4 | 0.1 |
| Q3 | 0 | 15 | 0 | 0.25 | 0 | 0.5 | 0 | 1 | 0 | 2 |
| Q4 | −30 | 15 | 0.4 | 0.2 | 0.9 | 0.4 | 1.9 | 1 | 3.9 | 2 |
| Q5 | 30 | 15 | −0.5 | 0.3 | −1 | 0.5 | −2 | 0.9 | −4 | 1.9 |
| Q6 | 0 | −15 | 0 | −0.25 | 0 | −0.5 | 0 | −1 | 0 | −2 |
| Q7 | −30 | −15 | 0.5 | −0.3 | 1 | −0.5 | 2 | −0.9 | 4 | −2 |
| Q8 | 30 | −15 | −0.5 | −0.2 | −1 | −0.4 | −2 | −1 | −4.1 | −2 |

Figure 8:
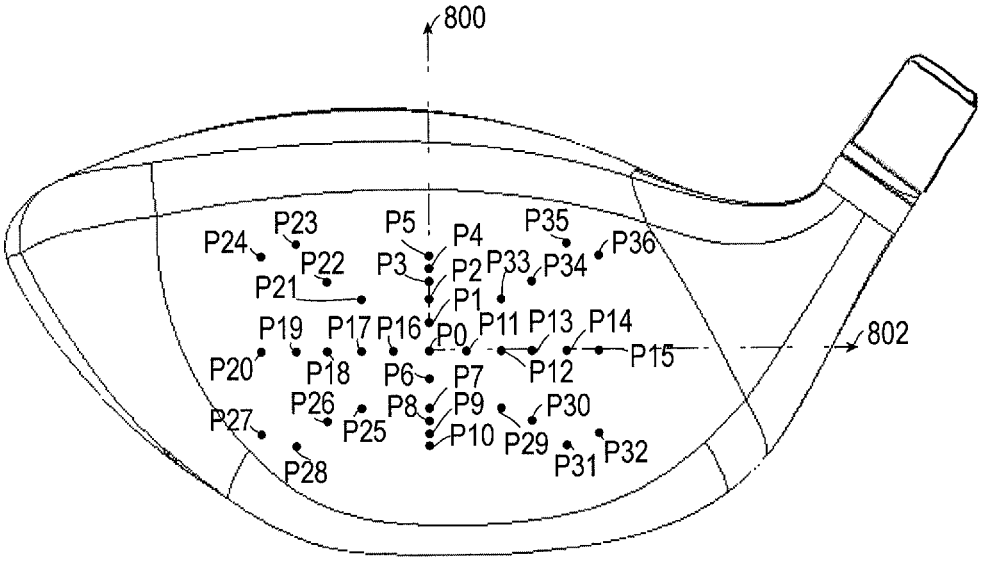
FIG. 8 illustrates a front view of a golf club with a predetermined set of measurement points.

FIG. 8 illustrates a plurality of points P0-P36 at which the face angle and loft angle are measured in a computer model. However, these same points can be measured on an actual golf club head utilizing the methods described above. Table 3 below provides the exact measurement of FA°Δ and LA°Δ at the thirty-seven plurality points spread across the golf club face. The FA°Δ and LA°Δ of each point is provided for two different embodiments having a 1° twist and 2° twist and a nominal center face loft angle of 9.2°, a bulge of 330.2 mm, and a roll of 279.4 mm are identified as Examples 5 and 6, respectively. Examples 5 and 6 are provided next to a golf club face that has 0° of twist for comparison purposes.

TABLE 3

| Relative to Center Face and Bands | | | | | | | | |
|---|---|---|---|---|---|---|---|---|
| | | | Example 5 1° twist | | Example 6 2° twist | | 0° twist | |
| Point | X-axis (mm) | Y-axis (mm) | LA°Δ | FA°Δ | LA°Δ | FA°Δ | LA°Δ | FA°Δ |
| P0 | 0 | 0 | 0.000 | 0.000 | 0.000 | 0.000 | 0.000 | 0.000 |
| P1 | 0 | 5 | 1.025 | 0.167 | 1.025 | 0.333 | 1.025 | 0.000 |
| P6 | 0 | −5 | −1.025 | −0.167 | −1.025 | −0.333 | −1.025 | 0.000 |
| P2 | 0 | 10 | 2.051 | 0.333 | 2.051 | 0.667 | 2.051 | 0.000 |
| P7 | 0 | −10 | −2.051 | −0.333 | −2.051 | −0.667 | −2.051 | 0.000 |
| P3 | 0 | 12 | 2.462 | 0.400 | 2.462 | 0.800 | 2.462 | 0.000 |
| P8 | 0 | −12 | −2.462 | −0.400 | −2.462 | −0.800 | −2.462 | 0.000 |
| P4 | 0 | 15 | 3.077 | 0.500 | 3.077 | 1.000 | 3.077 | 0.000 |
| P9 | 0 | −15 | −3.077 | −0.500 | −3.077 | −1.000 | −3.077 | 0.000 |
| P5 | 0 | 20 | 4.105 | 0.667 | 4.105 | 1.333 | 4.105 | 0.000 |
| P10 | 0 | −20 | −4.105 | −0.667 | −4.105 | −1.333 | −4.105 | 0.000 |
| P11 | 5 | 0 | −0.167 | −0.868 | −0.333 | −0.868 | 0.000 | −0.868 |
| P16 | −5 | 0 | 0.167 | 0.868 | 0.333 | 0.868 | 0.000 | 0.868 |
| P12 | 10 | 0 | −0.333 | −1.735 | −0.667 | −1.735 | 0.000 | −1.735 |
| P17 | −10 | 0 | 0.333 | 1.735 | 0.667 | 1.735 | 0.000 | 1.735 |
| P13 | 18 | 0 | −0.600 | −3.125 | −1.200 | −3.125 | 0.000 | −3.125 |
| P18 | −18 | 0 | 0.600 | 3.125 | 1.200 | 3.125 | 0.000 | 3.125 |
| P14 | 25 | 0 | −0.833 | −4.342 | −1.667 | −4.342 | 0.000 | −4.342 |
| P19 | −25 | 0 | 0.833 | 4.342 | 1.667 | 4.342 | 0.000 | 4.342 |
| P15 | 30 | 0 | −1.000 | −5.213 | −2.000 | −5.213 | 0.000 | −5.213 |
| P20 | −30 | 0 | 1.000 | 5.213 | 2.000 | 5.213 | 0.000 | 5.213 |
| P33 | 10 | 10 | −0.333 | 0.333 | −0.667 | 0.667 | 0.000 | 0.000 |
| P34 | 18 | 12 | −0.600 | 0.400 | −1.200 | 0.800 | 0.000 | 0.000 |
| P35 | 25 | 20 | −0.833 | 0.667 | −1.667 | 1.333 | 0.000 | 0.000 |
| P36 | 30 | 15 | −1.000 | 0.500 | −2.000 | 1.000 | 0.000 | 0.000 |
| P21 | −10 | 10 | 0.333 | 0.333 | 0.667 | 0.667 | 0.000 | 0.000 |
| P22 | −18 | 12 | 0.600 | 0.400 | 1.200 | 0.800 | 0.000 | 0.000 |
| P23 | −25 | 20 | 0.833 | 0.667 | 1.667 | 1.333 | 0.000 | 0.000 |
| P24 | −30 | 15 | 1.000 | 0.500 | 2.000 | 1.000 | 0.000 | 0.000 |
| P29 | 10 | −10 | −0.333 | −0.333 | −0.667 | −0.667 | 0.000 | 0.000 |
| P30 | 18 | −12 | −0.600 | −0.400 | −1.200 | −0.800 | 0.000 | 0.000 |
| P31 | 25 | −20 | −0.833 | −0.667 | −1.667 | −1.333 | 0.000 | 0.000 |
| P32 | 30 | −15 | −1.000 | −0.500 | −2.000 | −1.000 | 0.000 | 0.000 |
| P25 | −10 | −10 | 0.333 | −0.333 | 0.667 | −0.667 | 0.000 | 0.000 |
| P26 | −18 | −12 | 0.600 | −0.400 | 1.200 | −0.800 | 0.000 | 0.000 |
| P28 | −25 | −20 | 0.833 | −0.667 | 1.667 | −1.333 | 0.000 | 0.000 |
| P27 | −30 | −15 | 1.000 | −0.500 | 2.000 | −1.000 | 0.000 | 0.000 |

Table 3 shows the same nine key points of measurement shown in Table 1. Specifically, points P0, P4, P9, P15, P20, P24, P27, P32, and P36 correspond to the locations of points Q0-Q8 in Table 1. However, additional points have been measured to provide a higher resolution of the twisted face in Examples 5 and 6.

Point P5 located at x-y coordinate (0 mm, 20 mm) and point P10 located at x-y coordinate (0 mm, −20 mm) are helpful in determining the extreme face angle changes further away from the center face. In Example 5 of Table 3 at point P5, the FA°Δ is between 0.1° and 4°, between 0.2° and 3.5°, between 0.3° and 3°, between 0.4° and 3°, or between 0.5° and 2°. The LA°Δ at point P5 is between 1° and 10°, between 2° and 8°, between 3° and 7°, or between 3° and 6°.

In Example 5 of Table 3 at point P10, the FA°Δ is between −0.1° and −4°, between −0.2° and −3.5°, between −0.3° and −3°, between −0.4° and −3°, or between −0.5° and −2°. The LA°Δ at point P10 is between −1° and −10°, between −2° and −8°, between −3° and −7°, or between −3° and −6°.

Table 3 and FIG. 8 also show a plurality of points located in each quadrant. The upper toe quadrant has at least four measured points P21, P22, P23, P24. The lower toe quadrant has at least four measured points P25, P26, P27, P28. The upper heel quadrant has at least four measured points P33, P34, P35, P36. The lower heel quadrant has at least four measured points P29, P30, P31, P32.

The average of the FA°Δ and LA°Δ of the four points described in each quadrant are shown in Table 4 below.

TABLE 4

| Average in Quadrants | | | | | | |
|---|---|---|---|---|---|---|
| | Example 5 1° twist | | Example 6 2° twist | | 0° twist | |
| | Avg. LA°Δ | Avg. FA°Δ | Avg. LA°Δ | Avg. FA°Δ | Avg. LA°Δ | Avg. FA°Δ |
| Upper Toe Quadrant | 0.692 | 0.475 | 1.383 | 0.950 | 0.000 | 0.000 |
| Upper Heel Quadrant | −0.692 | 0.475 | −1.383 | 0.950 | 0.000 | 0.000 |
| Lower Toe Quadrant | 0.692 | −0.475 | 1.383 | −0.950 | 0.000 | 0.000 |
| Lower Heel Quadrant | −0.692 | −0.475 | −1.383 | −0.950 | 0.000 | 0.000 |

Table 4 shows that average FA°Δ in Example 5 for the upper toe quadrant and the upper heel quadrant are more open (more positive) than the 0° twist golf club head by more than 0.1°, more than 0.2°, more than 0.3°, or more than 0.4°. In some embodiments the upper toe quadrant and upper heel quadrant have an average FA°Δ more open than the 0° twist golf club by between 0.1° to 0.8°, 0.2° to 0.6°, or 0.3° to 0.5° more open. The lower toe quadrant and lower heel quadrant of Example 5 has a FA°Δ that is more closed (more negative) than the 0° twist golf club head. In some embodiments, the FA°Δ relative to a 0° twist club head in the lower toe quadrant and lower heel quadrant is less than −0.1°, less than −0.2, less than −0.3, or less than −0.4. In some embodiments, the FA°Δ relative to a 0° twist club head in the lower toe quadrant and lower heel quadrant is between −0.1° to −0.8°, −0.2° to −0.6°, or −0.3° to −0.5°.

Table 4 shows that average FA°Δ in Example 6 for the upper toe quadrant and the upper heel quadrant are more open (more positive) than the 0° twist golf club head by more than 0.6°, more than 0.7°, more than 0.8°, or more than 0.9°. In some embodiments the upper toe quadrant and upper heel quadrant are more open than the 0° twist golf club by between 0.6° to 1.2°, 0.7° to 1.1°, or 0.8° to 1° more open. The lower toe quadrant and lower heel quadrant of Example 6 has a FA°Δ that is more closed (more negative) than the 0° twist golf club head. In some embodiments, the FA°Δ relative to a 0° twist club head in the lower toe quadrant and lower heel quadrant is less than −0.6°, less than −0.7, less than −0.8, or less than −0.9. In some embodiments, the FA°Δ relative to a 0° twist club head in the lower toe quadrant and lower heel quadrant is between −0.6° to −1.2°, −0.7° to −1.1°, or −0.8° to −1°.

Table 4 shows that average LA°Δ in Example 5 for the upper toe quadrant and lower toe quadrant are more lofted (more positive) than the 0° twist golf club head by more than 0.2°, more than 0.3°, more than 0.4°, more than 0.5°, or more than 0.6°. In some embodiments, the upper toe quadrant and lower toe quadrant have a LA°Δ between 0.2° to 1°, between 0.3° to 0.9°, between 0.4° to 0.8°, or between 0.5° to 0.7° more lofted. The average LA°Δ of the upper heel quadrant and lower heel quadrant of Example 5 relative to a 0° twist club head are less lofted (more negative) than the 0° twist golf club head by less than −0.2° less than −0.3°, less than −0.4°, less than −0.5°, or less than −0.6°. In some embodiments, the upper heel quadrant and lower heel quadrant have a LA°Δ between −0.2° to −1°, between −0.3° to −0.9°, between −0.4° to −0.8°, or between −0.5° to −0.7° less lofted. The lower toe quadrant and upper toe quadrant of Example 5 are more lofted (more positive) than the 0° twist golf club head by more than 0.1° or between 0° to 1.5° more lofted. The lower heel quadrant and upper heel quadrant of Example 5 are less lofted (more negative) than the 0° twist golf club head by less than −0.1° or between 0° to −1° less lofted.

Table 4 shows that average LA°Δ in Example 6 for the upper toe quadrant and lower toe quadrant are more lofted (more positive) than the 0° twist golf club head by more than 0.5°, more than 0.6°, more than 0.7°, more than 0.8°, or more than 0.9°. In some embodiments, the upper toe quadrant and lower toe quadrant have a LA°Δ between 0.5° to 2.5°, between 0.6° to 2°, between 0.7° to 1.8°, or between 0.9° to 1.5° more lofted. The average LA°Δ of the upper heel quadrant and lower heel quadrant of Example 6 is less lofted (more negative) than the 0° twist golf club head by less than −0.5° less than −0.6°, less than −0.7°, less than −0.8°, or less than −0.9°. In some embodiments, the upper heel quadrant and lower heel quadrant have an average LA°Δ relative to 0° twist club head of between −0.5° to −2.5°, between −0.6° to −2°, between −0.7° to −1.8°, or between −0.9° to −1.5° less lofted. The lower toe quadrant and upper toe quadrant of Example 6 are more lofted (more positive) than the 0° twist golf club head by more than 0.1° or between 0° to 2.5° more lofted. The lower heel quadrant and upper heel quadrant of Example 6 are less lofted (more negative) than the 0° twist golf club head by less than −0.1° or between 0° to −2.5° less lofted.

Therefore, Examples 5 and 6 show a golf club head having four quadrants where the FA°Δ is more open (more positive) in the upper heel and toe quadrants and more closed (more negative) in the lower heel and toe quadrants. Examples 5 and 6 also show a golf club head having four quadrants where the LA°Δ is more lofted (more positive) in the upper toe quadrant and lower toe quadrant while being less lofted (more negative) in the upper heel quadrant and lower heel quadrant when compared to a 0° twist golf club head.

Figure 9:
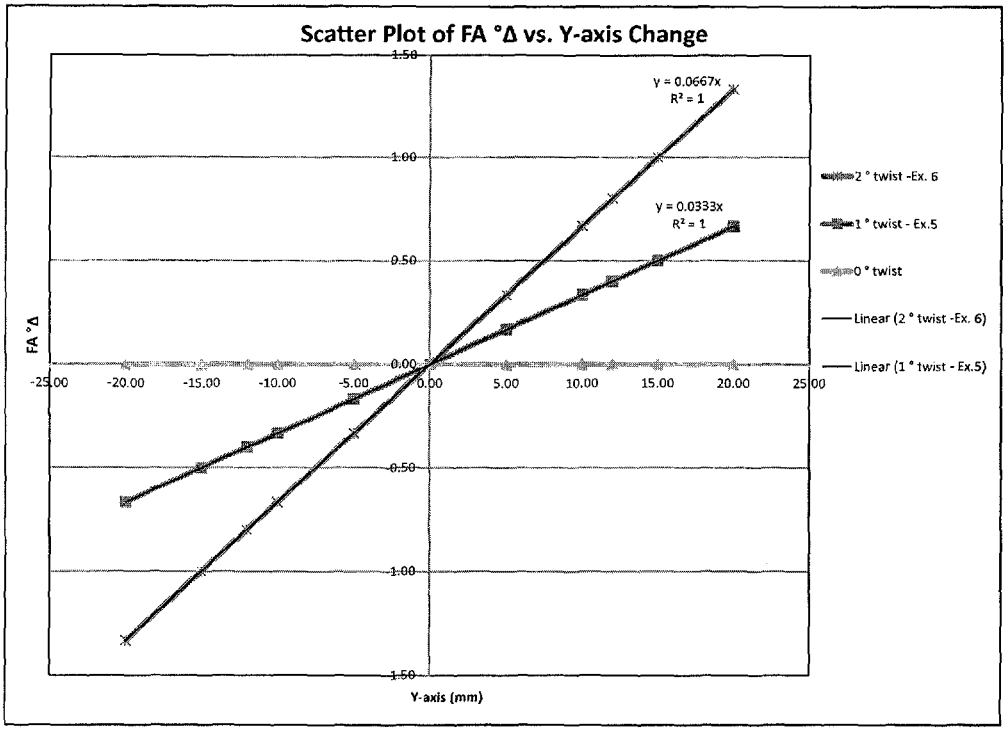
FIG. 9 is a graph showing a FA°Δ along a y-axis location.

FIG. 9 provides a chart showing the rate of change of FA°Δ relative to a y-axis 800 change with zero x-axis 802 change. In other words, FIG. 9 graphs the points P0-P10 shown in Table 3 above. It is noted that the points P0-P10 lie along the y-axis 800 only and have no x-axis 802 component. The rate of change is shown by the trend line fit to the measurements of Examples 5 and 6. The FA°Δ for Example 5 and 6 have a trend line defined as:

$$y=0.0333x \quad \text{(Eq. 1) Example 5}$$

$$y=0.0667x \quad \text{(Eq. 2) Example 6}$$

Equation 1 illustrates that for every 1 mm in movement along the y-axis 800, there is a relative FA°Δ of 0.0333° for a "1° twist" golf club head. Equation 2 shows that for every 1 mm in movement along the y-axis 800, there is a corresponding relative FA°Δ of 0.0667° for a "2° twist" golf club head. The slope of the equation describes the rate of change of the FA°Δ relative to the measurement point as it is moved along the y-axis 800. Therefore, the rate of change can be represented as an x/mm where x is the FA°Δ (in units of °Δ).

In some embodiments, the FA°Δ to y-axis rate of change is greater than zero, greater than 0.01°Δ/mm, greater than 0.02°Δ/mm, greater than 0.03°Δ/mm, greater than 0.04°Δ/mm, greater than 0.05°Δ/mm, or greater than 0.6°Δ/mm. In some embodiments, the FA°Δ to y-axis rate of change is between 0.005°Δ/mm and 0.2°Δ/mm, between 0.01°Δ/mm and 0.1°Δ/mm, between 0.02°Δ/mm and 0.09°Δ/mm, or between 0.03°Δ/mm and 0.08°Δ/mm.

Figure 10:
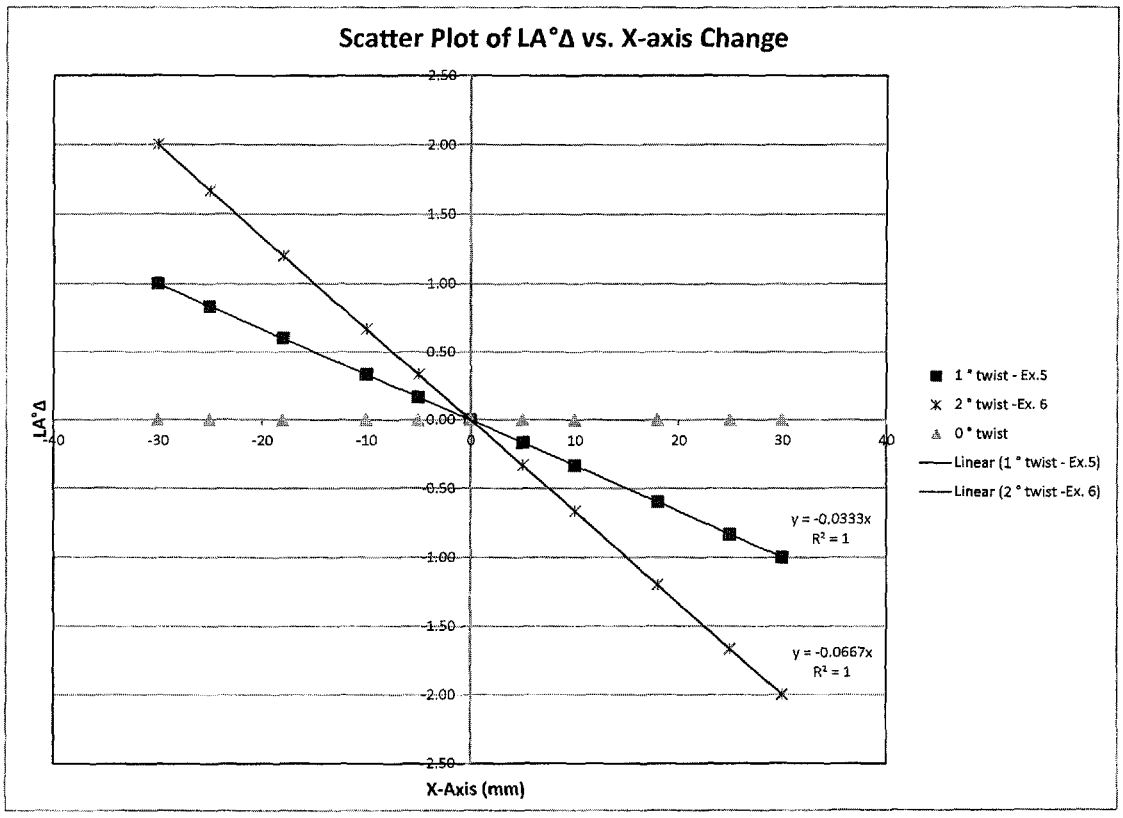
FIG. 10 is a graph showing a LA°Δ along a x-axis location.

FIG. 10 shows a chart illustrating the rate of change of the LA°Δ relative to an x-axis 802 change with zero y-axis 800 change. In other words, FIG. 10 graphs the points P11-P20 shown in Table 3 above. It is noted that the points P11-P20 lie along the x-axis 802 only and have no y-axis 800 component.

The LA°Δ for Example 5 and 6 have a trend line defined as:

$$y=-0.0333x \quad \text{(Eq. 3) Example 5}$$

$$y=-0.0667x \quad \text{(Eq. 4) Example 6}$$

Equation 3 illustrates that for every 1 mm in movement along the x-axis 802, there is a relative LA°Δ of −0.0333° for a "1° twist" golf club head. Equation 2 shows that for every 1 mm in movement along the x-axis 802, there is a corresponding relative LA°Δ of −0.0667° for a "2° twist" golf club head. The rate of change for the LA°Δ is negative for every positive movement along the x-axis 802.

In some embodiments, the LA°Δ to x-axis rate of change is less than zero for every millimeter, less than −0.01°Δ/mm, less than −0.02°Δ/mm, less than −0.03°Δ/mm, less than −0.04°Δ/mm, less than −0.05°Δ/mm, or less than −0.06°Δ/mm.

In some embodiments, the LA°Δ to x-axis rate of change is between −0.005°Δ/mm and −0.2°Δ/mm, between −0.01°Δ/mm and −0.1°Δ/mm, between −0.02°Δ/mm and −0.09°Δ/mm, or between −0.03°Δ/mm and −0.08°Δ/mm.

TABLE 5

| Relative to Zero Degree Twist | | | | | | |
|---|---|---|---|---|---|---|
| | X-axis | Y-axis | Example 5 1° twist | | Example 6 2° twist | |
| Point | (mm) | (mm) | LA°Δ | FA°Δ | LA°Δ | FA°Δ |
| P0 | 0 | 0 | 0.000 | 0.000 | 0.000 | 0.000 |
| P1 | 0 | 5 | 0.000 | 0.167 | 0.000 | 0.333 |
| P6 | 0 | −5 | 0.000 | −0.167 | 0.000 | −0.333 |
| P2 | 0 | 10 | 0.000 | 0.333 | 0.000 | 0.667 |

TABLE 5-continued

| Relative to Zero Degree Twist | | | | | | |
|---|---|---|---|---|---|---|
| | X-axis | Y-axis | Example 5 1° twist | | Example 6 2° twist | |
| Point | (mm) | (mm) | LA°Δ | FA°Δ | LA°Δ | FA°Δ |
| P7 | 0 | −10 | 0.000 | −0.333 | 0.000 | −0.667 |
| P3 | 0 | 12 | 0.000 | 0.400 | 0.000 | 0.800 |
| P8 | 0 | −12 | 0.000 | −0.400 | 0.000 | −0.800 |
| P4 | 0 | 15 | 0.000 | 0.500 | 0.000 | 1.000 |
| P9 | 0 | −15 | 0.000 | −0.500 | 0.000 | −1.000 |
| P5 | 0 | 20 | 0.000 | 0.667 | 0.000 | 1.333 |
| P10 | 0 | −20 | 0.000 | −0.667 | 0.000 | −1.333 |
| P11 | 5 | 0 | −0.167 | 0.000 | −0.333 | 0.000 |
| P16 | −5 | 0 | 0.167 | 0.000 | 0.333 | 0.000 |
| P12 | 10 | 0 | −0.333 | 0.000 | −0.667 | 0.000 |
| P17 | −10 | 0 | 0.333 | 0.000 | 0.667 | 0.000 |
| P13 | 18 | 0 | −0.600 | 0.000 | −1.200 | 0.000 |
| P18 | −18 | 0 | 0.600 | 0.000 | 1.200 | 0.000 |
| P14 | 25 | 0 | −0.833 | 0.000 | −1.667 | 0.000 |
| P19 | −25 | 0 | 0.833 | 0.000 | 1.667 | 0.000 |
| P15 | 30 | 0 | −1.000 | 0.000 | −2.000 | 0.000 |
| P20 | −30 | 0 | 1.000 | 0.000 | 2.000 | 0.000 |
| P33 | 10 | 10 | −0.333 | 0.333 | −0.667 | 0.667 |
| P34 | 18 | 12 | −0.600 | 0.400 | −1.200 | 0.800 |
| P35 | 25 | 20 | −0.833 | 0.667 | −1.667 | 1.333 |
| P36 | 30 | 15 | −1.000 | 0.500 | −2.000 | 1.000 |
| P21 | −10 | 10 | 0.333 | 0.333 | 0.667 | 0.667 |
| P22 | −18 | 12 | 0.600 | 0.400 | 1.200 | 0.800 |
| P23 | −25 | 20 | 0.833 | 0.667 | 1.667 | 1.333 |
| P24 | −30 | 15 | 1.000 | 0.500 | 2.000 | 1.000 |
| P29 | 10 | −10 | −0.333 | −0.333 | −0.667 | −0.667 |
| P30 | 18 | −12 | −0.600 | −0.400 | −1.200 | −0.800 |
| P31 | 25 | −20 | −0.833 | −0.667 | −1.667 | −1.333 |
| P32 | 30 | −15 | −1.000 | −0.500 | −2.000 | −1.000 |
| P25 | −10 | −10 | 0.333 | −0.333 | 0.667 | −0.667 |
| P26 | −18 | −12 | 0.600 | −0.400 | 1.200 | −0.800 |
| P28 | −25 | −20 | 0.833 | −0.667 | 1.667 | −1.333 |
| P27 | −30 | −15 | 1.000 | −0.500 | 2.000 | −1.000 |

Table 5 shows the same embodiments of Table 3 but provides the difference in LA°Δ and FA°Δ when compared to the golf club head with "0° twist" as the base comparison. Example 5 has up to about +/−1° of LA°Δ or up to about +/−0.7 FA°Δ when compared to the golf club head with "0° twist". Example 6 has up to about +/−2° of LA°Δ and up to +/−1.4 FA°Δ when compared to the golf club head with "0° twist".

In Examples 5 and 6, the LA°Δ and FA°Δ relative to center face remains unchanged at the center face location (0 mm, 0 mm) when compared to the "0° twist" head. However, all other points away from the center face location in Examples 5 and 6 also have some non-zero amount of change in either LA°Δ or FA°Δ.

The numbers provided in the Tables above show loft angle change or face angle change relative to center face location or relative to a key point within a band. However, the actual nominal face angle or loft angle can be calculated quantitatively for a desired point using the below equation:

$$LA = CFLA + \arcsin\left(\frac{YLOC}{\text{Roll}}\right) * \left(\frac{180}{PI}\right) - XLOC * \left(\frac{DEG}{30}\right) \quad \text{Eq. 5}$$

$$FA = CFFA - \arcsin\left(\frac{XLOC}{\text{Bulge}}\right) * \left(\frac{180}{PI}\right) + YLOC * \left(\frac{DEG}{30}\right) \quad \text{Eq. 6}$$

In Eq. 5 and Eq. 6 above, the variables are defined as:
Roll=Roll Radius (mm)
Bulge=Bulge Radius (mm)
LA=Nominal Loft Angle (°) at a desired point FA=Nominal Face Angle (°) at a desired point CFLA=Center Face Loft Angle (°)

CFFA=Center Face Face Angle (°)

YLOC=y-coordinate location on the y-axis of the predetermined point (mm)

XLOC=x-coordinate location on the x-axis of the predetermined point (mm)

DEG=degree of twist in the club head being measured (°)

By way of example, assume a golf club having a 1° twist, CFLA of 9.2°, a CFFA of 0°, a bulge of 330.2 mm, and a roll of 279.4 mm is provided, similar to Example 5 described in Table 3. In order to calculate the LA°Δ and FA°Δ at critical point P4 located at an x-y coordinate of (0 mm, 15 mm), 0 mm is utilized as the XLOC value and 15 mm as the YLOC value. The DEG value is 1°. When these variables are entered into Equation 5 above, a LA value of 12.277° and a FA value of 0.500° is calculated for critical point P4.

The LA°Δ is the nominal loft at the critical point P4 minus the center face loft. In this case, the CFLA is 9.2°. Therefore the LA°Δ is 12.277° minus 9.2° which equals 3.077° as shown in Table 3 at the critical point P4 in Example 5.

Likewise, Equation 6 yields the FA value of 0.500°. The FA°Δ is the nominal face angle, FA, at the critical point P4 minus the center face face angle. In this case, the CFFA is 0° (which is likely always the case). Therefore, the FA°Δ at critical point P4 is 0.500° minus 0° which equals 0.500° as shown in Table 3.

Thus, the FA°Δ and LA°Δ can be calculated at any desired x-y coordinate by calculating the nominal FA and LA values in Equations 5 and 6 above utilizing the necessary variables.

It is also possible to use the above equation to set bounds on the desired face shape for a given head. For example, if a head has a bulge radius (Bulge), and roll radius (Roll), it is possible to define two bounding surfaces for the desired twisted face surface by specifying two different twist amounts (DEG). In order to bound the example above, we can use a CFLA of 9.2°, a bulge of 330.2 mm, and a roll of 279.4 mm, then specify a range of twist of, for example 0.5°<DEG<1.5°. Then, preferably at least 50% of the face surface would have a FA and LA within the bounds of the equations using DEG=0.5° and DEG=1.5°. More preferably at least 70% of the face surface would have a FA and LA within the bounds of the equations using DEG=0.5° and DEG=1.5°. Most preferably at least 90% of the face surface would have a FA and LA within the bounds of the equations using DEG=0.5° and DEG=1.5°.

Similarly, if the target twist is, DEG=2.0°, then the upper/lower limits could be 1.5°<DEG<2.5°, and preferably 50%, or more preferably 70%, or most preferably 90% of the face surface would have a FA and LA within the bounds of the equations using those angles.

To make the upper/lower bound FA and LA equations more general for any driver with any bulge and roll, the process would be to define the amount of twist (i.e., 1°, 2°, 3°, etc.), then determine the desired CFLA, CFFA, Bulge and Roll, then define the upper bound equation using those parameters and a twist, DEG+, which is 0.5° higher than the target twist, DEG, and a lower bound with a twist, DEG−, which is 0.5° lower than the target twist, DEG. In this way, preferably 50%, or more preferably 70%, or most preferably 90% of the face surface would have a FA and LA within the bounds of the equations using DEG+ and DEG− and the desired CFLA, CFFA, Bulge and Roll.

For example, the range of CFLA can be between 7.5° and 16.0°, preferably 10.0°, the range of CFFA can be between −3.0° and +3.0°, preferably 0.0°, the range of Bulge can be between 228.6 mm to 457.2 mm, preferably 330.2 mm, and the range of Roll can be between 228.6 mm to 457.2 mm, preferably 279.4 mm. Any combination of these parameters within these ranges can be used to define the nominal FA and LA values over the face surface, and ranges of twist can range from 0.5° to 4.0°, preferably 1.0°.

Although the embodiments above describe a twisted face that has a generally open (more positive) FA°Δ in the upper toe and heel quadrant, it is also possible to create a golf club head with a closed (more negative) FA°Δ in the upper toe and heel quadrants. In other words, the twisting direction could be in the opposite direction of the embodiments described herein.

Because the twisted face described herein has a generally more open (more positive) face angle, the topline 280, shown in FIG. 2*d*, may appear more open or positive face angle to the golfer. For many golfers, this is a useful alignment feature which gives the golfer the confidence that the ball will not fly too far let. Thus, a twisted face golf club that is more open has the advantage of having a more open topline alignment appearance when the paint line of the crown ends at the intersection of the face and the crown at the topline 280.

In contrast, it is possible to have a golf club with a more negative or closed face twist in which case the topline 280 will have a more closed or negative face angle appearance to the golfer when the paint line occurs at the topline 280 of the face and crown intersection.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

The invention claimed is:

1. A golf club head comprising:

a hosel portion, a heel portion, a sole portion, a toe portion, a crown portion, and a striking face having a striking face surface;

the striking face having a center face location;

a center face vertical plane passing through the center face location, the center face vertical plane extending from adjacent the crown portion to adjacent the sole portion and intersecting with the striking face surface to define a center face roll contour;

a toe side vertical plane being spaced away from the center face vertical plane by 30 mm toward the toe portion, the toe side vertical plane extending from adjacent the crown portion to adjacent the sole portion and intersecting with the striking face surface to define a toe side roll contour;

a heel side vertical plane being spaced away from the center face vertical plane by 30 mm toward the heel portion, the heel side vertical plane extending from adjacent the crown portion to adjacent the sole portion and intersecting with the striking face surface to define a heel side roll contour;

a center face horizontal plane passing through the center face location, the center face horizontal plane extending from adjacent the toe portion to adjacent the heel portion and intersecting with the striking face surface to define a center face bulge contour;

a crown side horizontal plane being spaced away from the center face horizontal plane by 15 mm toward the crown portion, the crown side horizontal plane extending from adjacent the toe portion to adjacent the heel portion and intersecting with the striking face surface to define a crown side bulge contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side bulge contour;

wherein the toe side roll contour is more lofted than the center face roll contour, the heel side roll contour is less lofted than the center face roll contour, the crown side bulge contour is more open than the center face bulge contour, and the sole side bulge contour is more closed than the center face bulge contour, wherein the club head has a degree of twist that is between 0.1° and 5.0°;

wherein an actual nominal loft angle for any point on the striking face can be determined using the following equation:

$$LA = CFLA + \arcsin\left(\frac{YLOC}{\text{Roll}}\right) * \left(\frac{180}{PI}\right) - XLOC * \left(\frac{DEG}{30}\right);$$

and wherein an actual nominal face angle for any point on the striking face can be determined using the following equation:

$$FA = CFFA - \arcsin\left(\frac{XLOC}{\text{Bulge}}\right) * \left(\frac{180}{PI}\right) + YLOC * \left(\frac{DEG}{30}\right)$$

wherein in the equations above, the variables are defined as:

Roll=Roll Radius (mm),

Bulge=Bulge Radius (mm),

LA=Nominal Loft Angle (°) at a selected point,

FA=Nominal Face Angle (°) at a selected point,

CFLA=Center Face Loft Angle (°),

CFFA=Center Face Face Angle (°),

YLOC=y-coordinate location on the y-axis of the predetermined point (mm),

XLOC=x-coordinate location on the x-axis of the predetermined point (mm),

DEG=the degree of twist in the club head (°).

2. The golf club head of claim 1, wherein an average FA°Δ of an upper toe quadrant is between 0.3° to 0.5°.

3. The golf club head of claim 1, wherein an average LA°Δ of an upper toe quadrant is between 0.4° to 0.8°.

4. The golf club head of claim 1, wherein the striking face has a bulge radius between 228.6 mm and 355.6 mm.

5. The golf club head of claim 1, further comprising a sleeve portion connected to the hosel portion, the sleeve portion being capable of adjusting the loft, lie, or face angle of the club head when the sleeve portion is removed from the hosel portion in a first configuration and reinserted into the hosel portion in a second configuration.

6. The golf club head of claim 1, wherein the sole portion includes at least one weight port and an adjustable weight located in the at least one weight port.

7. The golf club head of claim 1, wherein the striking face has a variable face thickness having an inverted recess in a center portion of a back surface of the striking face.

8. The golf club head of claim 1, wherein the crown portion comprises a composite crown.

9. The golf club head of claim 1, wherein the sole portion comprises a recessed channel at a front portion of the sole portion.

10. A golf club comprising:

a hosel portion, a heel portion, a sole portion, a toe portion, a crown portion, and a striking face having a striking face surface;

a fastener opening configured to allow the insertion of a fastening member in order to attach and detach the golf club head relative to a shaft;

a sleeve portion connected to the shaft portion, the sleeve portion being capable of adjusting the loft, lie, or face angle of the club head when the sleeve portion is removed from the hosel portion in a first configuration and reinserted into the hosel portion in a second configuration;

the striking face having a center face location;

a center face vertical plane passing through the center face location, the center face vertical plane extending from adjacent the crown portion to adjacent the sole portion and intersecting with the striking face surface to define a center face roll contour;

a toe side vertical plane being spaced away from the center face vertical plane by 30 mm toward the toe portion, the toe side vertical plane extending from adjacent the crown portion to adjacent the sole portion and intersecting with the striking face surface to define a toe side roll contour;

a heel side vertical plane being spaced away from the center face vertical plane by 30 mm toward the heel portion, the heel side vertical plane extending from adjacent the crown portion to adjacent the sole portion and intersecting with the striking face surface to define a heel side roll contour;

a center face horizontal plane passing through the center face location, the center face horizontal plane extending from adjacent the toe portion to adjacent the heel portion and intersecting with the striking face surface to define a center face bulge contour;

a crown side horizontal plane being spaced away from the center face horizontal plane by 15 mm toward the crown portion, the crown side horizontal plane extending from adjacent the toe portion to adjacent the heel portion and intersecting with the striking face surface to define a crown side bulge contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side bulge contour;

wherein the toe side roll contour is more lofted than the center face roll contour, the heel side roll contour is less lofted than the center face roll contour, the crown side bulge contour is more open than the center face bulge contour, and the sole side bulge contour is more closed than the center face bulge contour;

wherein an actual nominal loft angle for any point on the striking face can be determined using the following equation:

$$LA = CFLA + \arcsin\left(\frac{YLOC}{\text{Roll}}\right) * \left(\frac{180}{PI}\right) - XLOC * \left(\frac{DEG}{30}\right);$$

and wherein an actual nominal face angle for any point on the striking face can be determined using the following equation:

$$FA = CFFA - \arcsin\left(\frac{XLOC}{\text{Bulge}}\right) * \left(\frac{180}{PI}\right) + YLOC * \left(\frac{DEG}{30}\right)$$

wherein in the equations above, the variables are defined as:

Roll=Roll Radius (mm),

Bulge=Bulge Radius (mm),

LA=Nominal Loft Angle (°) at a selected point,

FA=Nominal Face Angle (°) at a selected point,

CFLA=Center Face Loft Angle) (°),

CFFA=Center Face Face Angle (°),

YLOC=y-coordinate location on the y-axis of the predetermined point (mm),

XLOC=x-coordinate location on the x-axis of the predetermined point (mm),

DEG=degree of twist in the club head (°).

11. The golf club head of claim 10, wherein an average FA°Δ of an upper toe quadrant is between 0.3° to 0.5°.

12. The golf club head of claim 10, wherein an average LA°Δ of an upper toe quadrant is between 0.4° to 0.8°.

13. The golf club head of claim 10, wherein the striking face has a bulge radius between 228.6 mm and 355.6 mm.

14. The golf club head of claim 10, wherein the sole portion includes at least one weight port and an adjustable weight located in the at least one weight port.

15. The golf club head of claim 10, wherein the striking face has a variable face thickness having an inverted recess in a center portion of a back surface of the striking face.

16. The golf club head of claim 10, wherein the crown portion comprises a composite crown.

17. The golf club head of claim 10, wherein the sole portion comprises a recessed channel at a front portion of the sole portion.

18. The golf club head of claim 17, wherein the fastener opening is located in the recessed channel.

19. The golf club head of claim 17, further comprising internal ribs extending across sole portion and coupled to inner surfaces of the recessed channel.

20. A golf club comprising:

a hosel portion, a heel portion, a sole portion, a toe portion, a crown portion, and a striking face having a striking face surface;

a golf club shaft;

wherein the sole portion comprises a recessed channel at a front portion of the sole portion;

a fastener opening located in the recessed channel and configured to allow the insertion of a fastening member in order to attach and detach the golf club head relative to the shaft;

a sleeve portion connected to the shaft portion, the sleeve portion being capable of adjusting the loft, lie, or face angle of the golf club when the sleeve portion is removed from the hosel portion in a first configuration and reinserted into the hosel portion in a second configuration;

wherein the sole portion includes at least one weight port located rearward of the recessed channel, and an adjustable weight located in the at least one weight port;

wherein the crown portion comprises a composite crown;

wherein the striking face has a bulge radius between 228.6 mm and 355.6 mm;

the striking face having a center face location;

a center face vertical plane passing through the center face location, the center face vertical plane extending from adjacent the crown portion to adjacent the sole portion and intersecting with the striking face surface to define a center face roll contour;

a toe side vertical plane being spaced away from the center face vertical plane by 30 mm toward the toe portion, the toe side vertical plane extending from adjacent the crown portion to adjacent the sole portion and intersecting with the striking face surface to define a toe side roll contour;

a heel side vertical plane being spaced away from the center face vertical plane by 30 mm toward the heel portion, the heel side vertical plane extending from adjacent the crown portion to adjacent the sole portion and intersecting with the striking face surface to define a heel side roll contour;

a center face horizontal plane passing through the center face location, the center face horizontal plane extending from adjacent the toe portion to adjacent the heel portion and intersecting with the striking face surface to define a center face bulge contour;

a crown side horizontal plane being spaced away from the center face horizontal plane by 15 mm toward the crown portion, the crown side horizontal plane extending from adjacent the toe portion to adjacent the heel portion and intersecting with the striking face surface to define a crown side bulge contour;

a sole side horizontal plane being spaced away from the center face horizontal plane by 15 mm toward the sole portion, the sole side horizontal plane extending from adjacent the toe portion to adjacent the heel portion and intersecting with the striking face surface to define a sole side bulge contour;

wherein the toe side roll contour is more lofted than the center face roll contour, the heel side roll contour is less lofted than the center face roll contour, the crown side bulge contour is more open than the center face bulge contour, and the sole side bulge contour is more closed than the center face bulge contour;

wherein an average FA°Δ of an upper toe quadrant is between 0.3° to 0.5°;

wherein an average LA°Δ of an upper toe quadrant is between 0.4° to 0.8°;

wherein an actual nominal loft angle for any point on the striking face can be determined using the following equation:

$$LA = CFLA + \arcsin\left(\frac{YLOC}{\text{Roll}}\right) * \left(\frac{180}{PI}\right) - XLOC * \left(\frac{DEG}{30}\right);$$

and wherein an actual nominal face angle for any point on the striking face can be determined using the following equation:

$$FA = CFFA - \arcsin\left(\frac{XLOC}{\text{Bulge}}\right) * \left(\frac{180}{PI}\right) + YLOC * \left(\frac{DEG}{30}\right)$$

wherein in the equations above, the variables are defined as:

Roll=Roll Radius (mm),

Bulge=Bulge Radius (mm),

LA=Nominal Loft Angle(°)at a selected point,

FA=Nominal Face Angle (°) at a selected point,

CFLA=Center Face Loft Angle (°),

CFFA=Center Face Face Angle (°),

YLOC=y-coordinate location on the y-axis of the predetermined point (mm),

XLOC=x-coordinate location on the x-axis of the predetermined point (mm),

DEG=degree of twist in the club head (°).

* * * * *